US010968404B2

(12) United States Patent
Xu et al.

(10) Patent No.: US 10,968,404 B2
(45) Date of Patent: Apr. 6, 2021

(54) PYROLYSIS TAR UPGRADING

(71) Applicant: ExxonMobil Chemical Patents Inc., Baytown, TX (US)

(72) Inventors: Teng Xu, Houston, TX (US); Kapil Kandel, Humble, TX (US); Glenn A. Heeter, The Woodlands, TX (US); David T. Ferrughelli, Easton, PA (US); John S. Coleman, Houston, TX (US); Michael J. Clemmons, Mont Belvieu, TX (US); Jesse R. McManus, Baton Rouge, LA (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 0 days.

(21) Appl. No.: 16/467,749

(22) PCT Filed: Dec. 1, 2017

(86) PCT No.: PCT/US2017/064176

§ 371 (c)(1),
(2) Date: Jun. 7, 2019

(87) PCT Pub. No.: WO2018/111577

PCT Pub. Date: Jun. 21, 2018

(65) Prior Publication Data

US 2020/0071627 A1 Mar. 5, 2020

Related U.S. Application Data

(60) Provisional application No. 62/435,238, filed on Dec. 16, 2016.

(51) Int. Cl.
*C10G 45/72* (2006.01)
*C10G 31/10* (2006.01)
(Continued)

(52) U.S. Cl.
CPC ..... *C10G 45/72* (2013.01); *C10G 1/002* (2013.01); *C10G 1/02* (2013.01); *C10G 31/10* (2013.01);
(Continued)

(58) Field of Classification Search
None
See application file for complete search history.

(56) References Cited

U.S. PATENT DOCUMENTS 4,312,742 A 1/1982 Hayashi
5,871,634 A 2/1999 Wiehe et al.
(Continued)

FOREIGN PATENT DOCUMENTS

CN 106232778 12/2016
CN 106414673 2/2017
(Continued)

OTHER PUBLICATIONS

Process Pro Eric "Mitigating Hydroprocessing Reactor Fouling", Refiner Link, pp. 1-3, Apr. 23, 2018. (URL: http://www.refinerlink.com/blog/Mitigating_Hydroprocessing_Reactor_Fouling/).
(Continued)

*Primary Examiner* — Tam M Nguyen

(57) ABSTRACT

A process id disclosed for upgrading tars, typically those resulting from hydrocarbon refining processes, to products suitable for other uses, such as blending with other hydrocarbons to provide low-sulfur fuel oils or Emission Control Area-acceptable fuels. A low-sulfur hydrocarbon product obtained from the process is also disclosed.

22 Claims, 10 Drawing Sheets

(51) Int. Cl.

| | |
|---|---|
| ***C10G 45/00*** | (2006.01) |
| ***C10G 1/00*** | (2006.01) |
| ***C10G 69/06*** | (2006.01) |
| ***C10G 1/02*** | (2006.01) |
| ***C10G 47/36*** | (2006.01) |
| ***C10G 75/00*** | (2006.01) |

(52) U.S. Cl.

CPC ..... *C10G 45/00* (2013.01); *C10G 47/36* (2013.01); *C10G 69/06* (2013.01); *C10G 75/00* (2013.01); *C10G 2300/1003* (2013.01); *C10G 2300/201* (2013.01); *C10G 2300/202* (2013.01); *C10G 2300/205* (2013.01); *C10G 2300/207* (2013.01); *C10G 2300/208* (2013.01); *C10G 2300/301* (2013.01); *C10G 2300/302* (2013.01); *C10G 2300/304* (2013.01); *C10G 2300/308* (2013.01); *C10G 2300/4006* (2013.01); *C10G 2300/4018* (2013.01)

(56) References Cited

U.S. PATENT DOCUMENTS

| | | | | |
|---|---|---|---|---|
| 9,090,835 | B2 | 7/2015 | Beech, Jr. et al. | |
| 9,090,836 | B2 | 7/2015 | Brown et al. | |
| 9,102,884 | B2 | 8/2015 | Xu et al. | |
| 9,580,523 | B2 | 2/2017 | Wong et al. | |
| 9,637,694 | B2 | 5/2017 | Evans et al. | |
| 9,657,239 | B2 | 5/2017 | Beech, Jr. et al. | |
| 10,072,218 | B2 | 9/2018 | Chen et al. | |
| 2009/0272671 | A1 | 11/2009 | Keusenkothen | |
| 2010/0288679 | A1 | 11/2010 | Himelfarb | |
| 2011/0017642 | A1* | 1/2011 | Duyvesteyn ..... | B01J 19/26 208/390 |
| 2013/0015100 | A1* | 1/2013 | Pereira Almao ..... | C10G 9/36 208/80 |
| 2013/0081979 | A1 | 4/2013 | Brown et al. | |
| 2014/0061094 | A1 | 3/2014 | Xu et al. | |
| 2014/0061095 | A1 | 3/2014 | Beech, Jr. et al. | |
| 2014/0061096 | A1 | 3/2014 | Brown et al. | |
| 2014/0061100 | A1 | 3/2014 | Lattner et al. | |
| 2014/0174980 | A1 | 6/2014 | Brown et al. | |
| 2015/0122701 | A1 | 5/2015 | Shih et al. | |
| 2015/0141717 | A1 | 5/2015 | Frey et al. | |
| 2015/0315496 | A1 | 11/2015 | Soultanidis et al. | |
| 2015/0344785 | A1 | 12/2015 | Soultanidis et al. | |
| 2015/0344790 | A1 | 12/2015 | Ferrughelli et al. | |
| 2015/0353851 | A1 | 12/2015 | Buchanan | |
| 2015/0361354 | A1 | 12/2015 | Xu et al. | |
| 2015/0361359 | A1 | 12/2015 | Beech, Jr. et al. | |
| 2015/0368570 | A1 | 12/2015 | Beech, Jr. et al. | |
| 2016/0122667 | A1 | 5/2016 | Evans et al. | |
| 2016/0177205 | A1 | 6/2016 | Evans et al. | |
| 2017/0002273 | A1 | 1/2017 | Rubin-Pitel et al. | |
| 2019/0016969 | A1 | 1/2019 | Kandel et al. | |
| 2019/0300803 | A1* | 10/2019 | Emanuele ..... | C10G 69/06 |
| 2019/0367822 | A1 | 12/2019 | Kandel et al. | |
| 2019/0367825 | A1 | 12/2019 | Heeter et al. | |
| 2020/0063046 | A1 | 2/2020 | Kandel et al. | |
| 2020/0071627 | A1 | 3/2020 | Xu et al. | |

FOREIGN PATENT DOCUMENTS

| | | | |
|---|---|---|---|
| WO | 2013/033580 | A | 3/2013 |
| WO | 2013/033582 | A | 3/2013 |
| WO | 2013/033590 | A | 3/2013 |
| WO | 2015/191236 | A | 12/2015 |

OTHER PUBLICATIONS

U.S. Appl. No. 62/380,538, filed Aug. 29, 2016.

* cited by examiner

PYROLYSIS TAR UPGRADING

CROSS-REFERENCE OF RELATED APPLICATIONS

Priority Claim

This application is a National Phase Application claiming priority to P.C.T. Patent Application Serial No. PCT/US2017/064176, filed Dec. 1, 2017, which claims priority to and the benefit of U.S. Patent Application Ser. No. 62/435,238, filed Dec. 16, 2016, which are incorporated by reference in their entireties.

RELATED APPLICATIONS

This application is related to the following applications: U.S. patent application Ser. No. 15/829,034, filed Dec. 1, 2017; U.S. Patent Application Ser. No. 62/525,345, filed Jun. 27, 2017; PCT Patent Application No. PCT/US2017/064117, filed Dec. 1, 2017; U.S. Patent Application Ser. No. 62/561,478, filed Sep. 21, 2017; PCT Patent Application No. PCT/US2017/064128, filed Dec. 1, 2017; PCT Patent Application No. PCT/US2017/064165, filed Dec. 1, 2017; U.S. Patent Application Ser. No. 62/571,829, filed Oct. 13, 2017; and PCT Patent Application No. PCT/US2017/064140, filed Dec. 1, 2017; which are incorporated by reference in their entireties.

FIELD

The disclosure relates to processes for upgrading tar to a product suitable for blending into fuels, to provide, for instance, a low sulfur fuel oil or an Emission Controlled Area fuel. The disclosure also relates to apparatus useful for carrying out such processes; to the products of such processes, including products containing the processed tar and/or the upgraded tar; and to blends containing such products.

BACKGROUND

Disposition of steam cracked tar (SCT) has been a long-standing challenge for steam cracking operations. A typical steam cracking process can be expected to generate a few weight percent to 20 wt. % of tar. Decades of research has investigated various options for upgrading tar to more valuable dispositions and to reduce tar yield. For example, tar can be converted to syngas. SCT as boiler fuel is another relatively high value disposition, but the demand for boiler fuel is limited, and so only a small amount of tar can be processed that way. Power/electricity generation has also been considered. The amount of power generated from SCT far exceeds the power need of the cracker, making it necessary to sell electricity into highly-regulated markets. SCT has also been proposed as a carbon black feedstocks (CBFS), but again there is concern whether CBFS economics can support the use of commercial quantities of tar (e.g., more than about 550,000 tonnes per year). Furthermore, CBFS has a low sulfur specification of about 1 wt. %. Since SCT contains a significant amount of the steam cracker feed's sulfur, stringent CBFS sulfur specifications lead to an undesirable limitation on steam cracker feed selection.

Direct blending of tar into fuel oil has also been considered. Unfortunately, SCT-fuel oil compatibility issues typically result in a precipitation of SCT asphaltenes in the blend. Although tar can be blended into the high sulfur fuel oil ("HSFO") pool, typically a large amount of higher-value flux, e.g., gas oil in a flux amount of 40% or more, is needed to sufficiently reduce SCT viscosity for HSFO blending.

Therefore, there are strong business drivers for finding more attractive, and ideally more broadly applicable, SCT dispositions, e.g., those involving SCT hydroprocessing. For example, SCT hydroconversion has been attempted at a typical temperature range from 250° C. to 380° C. The conventional hydroconversion process with SCT encountered significant deactivation of catalysts due to catalyst fouling. As a result, there remains a need for an improved process for hydroconverting SCT, as well as other tars.

SUMMARY

The present disclosure provides a process for upgrading tars, for example an SCT, to higher-value, lower-viscosity, and/or lower-sulfur products. The products of the disclosed process are compatible for blending to provide fuels, such as a low sulfur fuel oil ("LSFO") or a product acceptable as a fuel in an Emissions Controlled Area.

The disclosed process provides a low sulfur liquid hydrocarbon product by steps comprising:

i) heat soaking a tar stream to obtain a first process stream comprising reduced reactivity tar;

ii) blending the first process stream with a utility fluid to reduce the viscosity of the first process stream and obtain a second process stream comprising reduced reactivity, lower viscosity tar;

iii) removing solids from the second process stream to provide a third process stream comprising a reduced reactivity, lower viscosity tar that is substantially free of solids of size larger than 25 μm;

iv) pretreating the third process stream to further lower the reactivity of the tar and obtain a fourth process tar stream having a Bromine Number (BN) lower than 12 BN;

v) processing (e.g., by hydrogenating and/or desulfurizing) the fourth process stream and recovering a total liquids product (TLP);

vi) separating from the TLP (e.g., by distillation) a first product and a second product (e.g., heavy bottoms fraction), the second product having a greater density than the first product; and vii) processing (e.g., by desulfurizing) the second product to obtain a low-sulfur product having a sulfur content≤0.5 wt. % based on the weight of the second product.

In such a process a portion of the first product can be recycled to provide at least a portion, which can be up to 100%, of the utility fluid used in step ii). In such a process, the first product can be a mid-cut fraction of TLP distillation products, the mid-cut fraction having an atmospheric pressure boiling range of from 177° C. to 454° C. (350° F. to 850° F.).

The disclosed process can further comprise blending the low sulfur product with a refinery stream or ECA-compliant stream.

DETAILED DESCRIPTION

Figure 1:
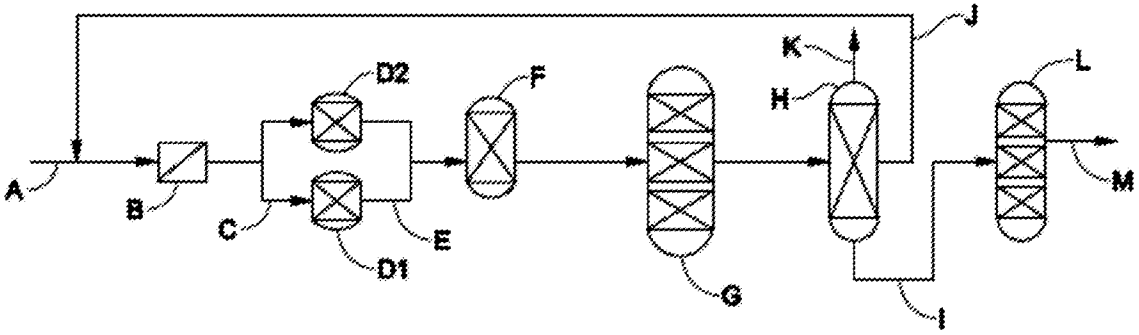
FIG. 1 shows an exemplary process flow of a tar disposition method as disclosed herein.

Pyrolysis tar is often high in density and sulfur. Sulfur content typically varies from less than 1 wt. % to 5 wt. %. Density typically varies from 1.14 g/cm$^3$ to 1.18 g/cm$^3$. One way in which tar is presently disposed is as a blending stock for producing HSFO, which has a sulfur specification of ≤3.5 wt. % and a density specification of ≤0.991 g/ml. Due to regulatory changes consumers of HSFO may need to use instead LSFO which has a sulfur specification of ≤0.5 wt. %. As a result, there is a need to upgrade tar by reducing sulfur and density (and improving many other properties associated with tar such as incompatibility, cetane number, etc).

Definitions

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is ≥about 550° F. (290° C.). Certain pyrolysis tars have an initial boiling point≥200° C. For certain pyrolysis tars, ≥90.0 wt. % of the pyrolysis tar has a boiling point at atmospheric pressure≥550° F. (290° C.). Pyrolysis tar can comprise, e.g., ≥50.0 wt. %, e.g., ≥75.0 wt. %, such as ≥90.0 wt. %, based on the weight of the pyrolysis tar, of hydrocarbon molecules (including mixtures and aggregates thereof) having (i) one or more aromatic components, and (ii) a number of carbon atoms≥about 15. Pyrolysis tar generally has a metals content≤$1.0\times10^3$ ppmw, based on the weight of the pyrolysis tar, which is an amount of metals that is far less than that found in crude oil (or crude oil components) of the same average viscosity. "SCT" means pyrolysis tar obtained from steam cracking.

"Olefin content" means the portion of the tar that contains hydrocarbon molecules having olefinic unsaturation (at least one unsaturated carbon that is not an aromatic unsaturation) where the hydrocarbon may or may not also have aromatic unsaturation. For instance, a vinyl hydrocarbon like styrene, if present in the pyrolysis tar, would be included in the olefin content. Pyrolysis tar reactivity has been found to correlate strongly with the pyrolysis tar's olefin content.

Generally, tar is hydroprocessed in the presence of the specified utility fluid, e.g., as a mixture of tar and the specified utility fluid (a "tar-fluid" mixture). Although it is typical to determine reactivity ("$R_M$") of a tar-fluid mixture comprising a thermally-treated pyrolysis tar composition of reactivity $R_C$, it is within the scope of the invention to determine reactivity of the pyrolysis tar ($R_T$ and/or $R_M$) itself. Utility fluids generally have a reactivity $R_U$ that is much less than pyrolysis tar reactivity. Accordingly, $R_C$ of a pyrolysis tar composition can be derived from $R_M$ of a tar-fluid mixture comprising the pyrolysis tar composition, and vice versa, using the relationship $R_M$~[$R_C$*(weight of tar)+$R_U$*(weight of utility fluid)]/(weight of tar+weight of utility fluid). For instance, if a utility fluid having $R_U$ of 3 BN, and the utility fluid is 40% by weight of the tar-fluid mixture, and if $R_C$ (the reactivity of the neat pyrolysis tar composition) is 18 BN, then $R_M$ is approximately 12 BN.

"Tar Heavies" (TH) are a product of hydrocarbon pyrolysis having an atmospheric boiling point≥565° C. and comprising ≥5.0 wt. % of molecules having a plurality of aromatic cores based on the weight of the product. The TH are typically solid at 25° C. and generally include the fraction of SCT that is not soluble in a 5:1 (vol.:vol.) ratio of n-pentane:SCT at 25° C. TH generally includes asphaltenes and other high molecular weight molecules.

Insolubles Content ("IC") means the amount in wt. % of components of a hydrocarbon-containing composition that are insoluble in a mixture of 25% by volume heptane and 75% by volume toluene. The hydrocarbon-containing composition can be an asphaltene-containing composition, e.g., one or more of pyrolysis tar; thermally-treated pyrolysis tar; hydroprocessed pyrolysis tar; and mixtures comprising a first hydrocarbon-containing component and a second component which includes one or more of pyrolysis tar, thermally-treated pyrolysis tar, and hydroprocessed pyrolysis tar.

IC is determined as follows: First, estimate the composition's asphaltene content, e.g., using conventional methods. Next, produce a mixture by adding a test portion of the heptane-toluene mixture to a flask containing a test portion of the pyrolysis tar of weight $W_1$. The test portion of the heptane-toluene mixture is added to the test portion of the heptane-toluene mixture at ambient conditions of 25° C. and 1 bar (absolute) pressure. The following table indicates the test portion amount ($W_1$, in grams), the heptane-toluene mixture amount (in mL), and the flask volume (in mL) as a function of the composition's estimated asphaltene content.

TABLE 1

Test Portion Size, Flask, and Heptane Volumes

| Estimated Asphaltene Content % m/m | Test Portion Size g | Flask Volume mL | Heptane Volume mL |
|---|---|---|---|
| Less than 0.5 | 10 ± 2 | 1000 | 300 ± 60 |
| 0.5 to 2.0 | 8 ± 2 | 500 | 240 ± 60 |
| Over 2.0 to 5.0 | 4 ± 1 | 250 | 120 ± 30 |
| Over 5.0 to 10.0 | 2 ± 1 | 150 | 60 ± 15 |

TABLE 1-continued

| Test Portion Size, Flask, and Heptane Volumes | | | |
|---|---|---|---|
| Estimated Asphaltene Content % m/m | Test Portion Size g | Flask Volume mL | Heptane Volume mL |
| Over 10.00 to 25.0 | 0.8 ± 0.2 | 100 | 25 to 30 |
| Over 25.0 | 0.5 ± 0.2 | 100 | 25 ± 1 |

While maintaining the ambient conditions, cap the flask and mix the heptane-toluene mixture with the indicated amount of the composition in the flask until substantially all of the composting has dissolved, and then allow the contents of the capped flask to rest for at least 12 hours. Next, decant the rested contents of the flask through a filter paper of 2 μm pore size and weight $W_2$ positioned within a Buchner funnel. Next, wash the filter paper with fresh heptane-toluene mixture (25:75 vol.:vol.), and allow the filter paper to dry. Next, place the dried filter paper in an oven to allow the filter paper to achieve a temperature of 60° C. for a time period in the range of from 10 minutes to 30 minutes, and allow the filter paper to cool. After cooling, record the weight $W_3$ of the cooled filter paper. IC is determined from the equation $IC=(W_3-W_2)/W_1$. It is particularly desired for fuel oils, and even more particularly for transportation fuel oils such as marine fuel oils, to have an IC that is ≤6 wt. %, e.g., ≤5 wt. %, such as ≤4 wt. %, or ≤3 wt. %, or ≤2 wt. %, or ≤1 wt. %.

Process Overview

FIG. 1 shows an overview of certain aspects of the instant process. A tar stream to be processed A is thermally treated to reduce reactivity during transport to a centrifuge B. A utility fluid J (which may act as a solvent for at least a portion of the tar's hydrocarbon compounds) may be added to the tar stream to reduce viscosity. Utility fluid may be recovered from the process for recycle to as shown. A filter (not shown) may be included in the transport line to remove relatively large insoluble, e.g., relatively large solids. The thermally processed tar stream is centrifuged to remove insoluble (e.g., solids) larger than 25 μm. The "cleared" liquid product tar stream is fed to a guard reactor, in the present illustration via a pretreatment manifold C, which directs the tar stream between an online guard reactor D1 and a guard reactor D2 that can be held offline, for instance for maintenance. The guard reactor is operated under mild hydroprocessing conditions to further reduce the tar reactivity. The effluent from the guard reactor passes through an outlet manifold E to a pretreatment hydroprocessing reactor F for further hydroprocessing under somewhat harsher conditions and with a more active catalyst. The effluent from the pretreatment hydroprocessing reactor passes to a main hydroprocessing reactor G for further hydroprocessing under yet more severe conditions to obtain a Total Liquid Product ("TLP") that is of blending quality, but typically remains somewhat high in sulfur. Recovery facility H includes at least one separation, e.g., fractionation, for separating from the TLP (i) a light stream K suitable for fuels use, (ii) a bottom fraction I which includes heavier components of the TLP, and (iii) a mid-cut. At least a portion of the mid-cut can be recycled to the tar feed as utility fluid via line J. The bottoms fraction I is fed to a $2^{nd}$ Stage hydroprocessing reactor L for an additional hydroprocessing step that provides desulfurization. The effluent stream M from the $2^{nd}$ Stage hydroprocessing reactor is of low sulfur content and is suitable for blending into an ECA compliant fuel.

Pyrolysis Tar

Representative tars, such as pyrolysis tars, will now be described in more detail. The invention is not limited to use of these pyrolysis tars, and this description is not meant to foreclose use of other pyrolysis tars, e.g., tars derived from the pyrolysis of coal and/or the pyrolysis of biological material (e.g., biomass) within the broader scope of the invention.

Pyrolysis tar is a product or by-product of hydrocarbon pyrolysis, e.g., steam cracking. Effluent from the pyrolysis is typically in the form of a mixture comprising unreacted feed, unsaturated hydrocarbon produced from the feed during the pyrolysis, and pyrolysis tar. The pyrolysis tar typically comprises ≥90 wt. %, of the pyrolysis effluent's molecules having an atmospheric boiling point of ≥290° C. Besides hydrocarbon, the feed to pyrolysis optionally further comprises diluent, e.g., one or more of nitrogen, water, etc.

Steam cracking, which produces SCT, is a form of pyrolysis which uses a diluent comprising an appreciable amount of steam. Steam cracking will now be described in more detail. The invention is not limited to use of pyrolysis tars produced by steam cracking, and this description is not meant to foreclose utilization of pyrolysis tar formed by other pyrolysis methods within the broader scope of the invention.

Steam Cracking

A steam cracking plant typically comprises a furnace facility for producing steam cracking effluent and a recovery facility for removing from the steam cracking effluent a plurality of products and by-products, e.g., light olefin and pyrolysis tar. The furnace facility generally includes a plurality of steam cracking furnaces. Steam cracking furnaces typically include two main sections: a convection section and a radiant section, the radiant section typically containing fired heaters. Flue gas from the fired heaters is conveyed out of the radiant section to the convection section. The flue gas flows through the convection section and is then conducted away, e.g., to one or more treatments for removing combustion by-products such as $NO_x$. Hydrocarbon is introduced into tubular coils (convection coils) located in the convection section. Steam is also introduced into the coils, where it combines with the hydrocarbon to produce a steam cracking feed. The combination of indirect heating by the flue gas and direct heating by the steam leads to vaporization of at least a portion of the steam cracking feed's hydrocarbon component. The steam cracking feed containing the vaporized hydrocarbon component is then transferred from the convection coils to tubular radiant tubes located in the radiant section. Indirect heating of the steam cracking feed in the radiant tubes results in cracking of at least a portion of the steam cracking feed's hydrocarbon component. Steam cracking conditions in the radiant section, can include, e.g., one or more of (i) a temperature in the range of 760° C. to 880° C., (ii) a pressure in the range of from 1.0 to 5.0 bars (absolute), or (iii) a cracking residence time in the range of from 0.10 to 2.0 seconds.

Steam cracking effluent is conducted out of the radiant section and is quenched, typically with water or quench oil. The quenched steam cracking effluent ("quenched effluent") is conducted away from the furnace facility to the recovery facility, for separation and recovery of reacted and unreacted components of the steam cracking feed. The recovery facility typically includes at least one separation stage, e.g., for separating from the quenched effluent one or more of light olefin, steam cracker naphtha, steam cracker gas oil, SCT, water, light saturated hydrocarbon, molecular hydrogen, etc.

Steam cracking feed typically comprises hydrocarbon and steam, e.g., ≥10.0 wt. % hydrocarbon, based on the weight of the steam cracking feed, e.g., ≥25.0 wt. %, ≥50.0 wt. %, such as ≥65 wt. %. Although the hydrocarbon can comprise one or more light hydrocarbons such as methane, ethane, propane, butane etc., it can be particularly advantageous to include a significant amount of higher molecular weight hydrocarbon. While doing so typically decreases feed cost, steam cracking such a feed typically increases the amount of SCT in the steam cracking effluent. One suitable steam cracking feed comprises ≥1.0 wt. %, e.g., ≥10 wt. %, such as ≥25.0 wt. %, or ≥50.0 wt. % (based on the weight of the steam cracking feed) of hydrocarbon compounds that are in the liquid and/or solid phase at ambient temperature and atmospheric pressure.

The hydrocarbon portion of a steam cracking feed typically comprises ≥10.0 wt. %, e.g., ≥50.0 wt. %, such as ≥90.0 wt. % (based on the weight of the hydrocarbon) of one or more of naphtha, gas oil, vacuum gas oil, waxy residues, atmospheric residues, residue admixtures, or crude oil; including those comprising ≥about 0.1 wt. % asphaltenes. When the hydrocarbon includes crude oil and/or one or more fractions thereof, the crude oil is optionally desalted prior to being included in the steam cracking feed. A crude oil fraction can be produced by separating atmospheric pipestill ("APS") bottoms from a crude oil followed by vacuum pipestill ("VPS") treatment of the APS bottoms. One or more vapor-liquid separators can be used upstream of the radiant section, e.g., for separating and conducting away a portion of any non-volatiles in the crude oil or crude oil components. In certain aspects, such a separation stage is integrated with the steam cracker by preheating the crude oil or fraction thereof in the convection section (and optionally by adding of dilution steam), separating a bottoms steam comprising non-volatiles, and then conducting a primarily vapor overhead stream as feed to the radiant section.

Suitable crude oils include, e.g., high-sulfur virgin crude oils, such as those rich in polycyclic aromatics. For example, the steam cracking feed's hydrocarbon can include ≥90.0 wt. % of one or more crude oils and/or one or more crude oil fractions, such as those obtained from an atmospheric APS and/or VPS; waxy residues; atmospheric residues; naphthas contaminated with crude; various residue admixtures; and SCT.

SCT is typically removed from the quenched effluent in one or more separation stages, e.g., as a bottoms stream from one or more tar drums. Such a bottoms stream typically comprises ≥90.0 wt. % SCT, based on the weight of the bottoms stream. The SCT can have, e.g., a boiling range≥about 550° F. (290° C.) and can comprise molecules and mixtures thereof having a number of carbon atoms≥about 15. Typically, quenched effluent includes ≥1.0 wt. % of $C_2$ unsaturates and ≥0.1 wt. % of TH, the weight percents being based on the weight of the pyrolysis effluent. It is also typical for the quenched effluent to comprise ≥0.5 wt. % of TH, such as ≥1.0 wt. % TH.

Representative SCTs will now be described in more detail. The invention is not limited to use of these SCTs, and this description is not meant to foreclose the processing of other pyrolysis tars within the broader scope of the invention.

Steam Cracker Tar

Conventional separation equipment can be used for separating SCT and other products and by-products from the quenched steam cracking effluent, e.g., one or more flash drums, knock out drums, fractionators, water-quench towers, indirect condensers, etc. Suitable separation stages are described in U.S. Pat. No. 8,083,931, for example. SCT can be obtained from the quenched effluent itself and/or from one or more streams that have been separated from the quenched effluent. For example, SCT can be obtained from a steam cracker gas oil stream and/or a bottoms stream of the steam cracker's primary fractionator, from flash-drum bottoms (e.g., the bottoms of one or more tar knock out drums located downstream of the pyrolysis furnace and upstream of the primary fractionator), or a combination thereof. Certain SCTs are a mixture of primary fractionator bottoms and tar knock-out drum bottoms.

A typical SCT stream from one or more of these sources generally contains ≥90.0 wt. % of SCT, based on the weight of the stream, e.g., ≥95.0 wt. %, such as ≥99.0 wt. %. More than 90 wt. % of the remainder of the SCT stream's weight (e.g., the part of the stream that is not SCT, if any) is typically particulates. The SCT typically includes ≥50.0 wt. %, e.g., ≥75.0 wt. %, such as ≥90.0 wt. % of the quenched effluent's TH, based on the total weight TH in the quenched effluent.

The TH are typically in the form of aggregates which include hydrogen and carbon and which have an average size in the range of 10.0 nm to 300.0 nm in at least one dimension and an average number of carbon atoms≥50. Generally, the TH comprise ≥50.0 wt. %, e.g., ≥80.0 wt. %, such as ≥90.0 wt. % of aggregates having a C:H atomic ratio in the range of from 1.0 to 1.8, a molecular weight in the range of 250 to 5000, and a melting point in the range of 100° C. to 700° C.

Representative SCTs typically have (i) a TH content in the range of from 5.0 wt. % to 40.0 wt. %, based on the weight of the SCT, (ii) an API gravity (measured at a temperature of 15.8° C.) of ≤8.5° API, such as ≤8.0° API, or ≤7.5° API; and (iii) a 50° C. viscosity in the range of 200 cSt to $1.0\times10^7$ cSt, e.g., $1\times10^3$ cSt to $1.0\times10^7$ cSt, as determined by A.S.T.M. D445. The SCT can have, e.g., a sulfur content that is >0.5 wt. %, or >1 wt. %, or more, e.g., in the range of 0.5 wt. % to 7.0 wt. %, based on the weight of the SCT. In aspects where steam cracking feed does not contain an appreciable amount of sulfur, the SCT can comprise ≤0.5 wt. % sulfur, e.g., ≤0.1 wt. %, such as ≤0.05 wt. % sulfur, based on the weight of the SCT.

The SCT can have, e.g., (i) a TH content in the range of from 5.0 wt. % to 40.0 wt. %, based on the weight of the SCT; (ii) a density at 15° C. in the range of 1.01 g/cm$^3$ to 1.19 g/cm$^3$, e.g., in the range of 1.07 g/cm$^3$ to 1.18 g/cm$^3$; and (iii) a 50° C. viscosity≥200 cSt, e.g., ≥600 cSt, or in the range of from 200 cSt to $1.0\times10^7$ cSt. The specified hydroprocessing is particularly advantageous for SCTs having 15° C. density that is ≥1.10 g/cm$^3$, e.g., ≥1.12 g/cm$^3$, ≥1.14 g/cm$^3$, ≥1.16 g/cm$^3$, or ≥1.17 g/cm$^3$. Optionally, the SCT has a 50° C. kinematic viscosity≥$1.0\times10^4$ cSt, such as ≥$1.0\times10^5$ cSt, or ≥$1.0\times10^6$ cSt, or even ≥$1.0\times10^7$ cSt. Optionally, the SCT has an $I_N$>80 and >70 wt. % of the pyrolysis tar's molecules have an atmospheric boiling point of ≥290° C. Typically, the SCT has an insoluble content ("$IC_T$")≥0.5 wt. %, e.g., ≥1 wt. %, such as ≥2 wt. %, or ≥4 wt. %, or ≥5 wt. %, or ≥10 wt. %.

Optionally, the SCT has a normal boiling point≥290° C., a viscosity at 15° C.≥$1\times10^4$ cSt, and a density≥1.1 g/cm$^3$. The SCT can be a mixture which includes a first SCT and one or more additional pyrolysis tars, e.g., a combination of the first SCT and one or more additional SCTs. When the SCT is a mixture, it is typical for at least 70 wt. % of the mixture to have a normal boiling point of at least 290° C., and include olefinic hydrocarbon which contribute to the tar's reactivity under hydroprocessing conditions. When the mixture comprises first and second pyrolysis tars (one or more of which is optionally an SCT)≥90 wt. % of the second pyrolysis tar optionally has a normal boiling point≥290° C.

It has been found that an increase in reactor fouling occurs during hydroprocessing of a tar-fluid mixture comprising an SCT having an excessive amount of olefinic hydrocarbon. In order to lessen the amount of reactor fouling, it is beneficial for an SCT in the tar-fluid mixture to have an olefin content of ≤10.0 wt. % (based on the weight of the SCT), e.g., ≤5.0 wt. %, such as ≤2.0 wt. %. More particularly, it has been observed that less reactor fouling occurs during the hydroprocessing when the SCT in the tar-fluid mixture has (i) an amount of vinyl aromatics of ≤5.0 wt. % (based on the weight of the SCT), e.g., ≤3 wt. %, such as ≤2.0 wt. % and/or (ii) an amount of aggregates which incorporate vinyl aromatics of ≤5.0 wt. % (based on the weight of the SCT), e.g., ≤3 wt. %, such as ≤2.0 wt. %. It is also observed that less fouling of the guard reactor and/or pretreater occurs when the thermally treated tar (e.g., heat soaked SCT) is subjected to the specified insolubles-removal treatment, e.g., using filtration and/or centrifugation. The decreased fouling in the guard reactor and pretreater is advantageous because it results in longer guard reactor and pretreater run lengths, e.g., run lengths comparable to those of reactors G and L (FIG. 1). This decreases the need for additional guard reactor and pretreater reactors, which would otherwise be needed, e.g., to substitute for a pretreater reactor brought off-line for regeneration while reactors G and L continue in operation. See, e.g., guard reactor 704B, which can be brought on-line while guard reactor 704A undergoes regeneration, e.g., by stripping with molecular hydrogen.

Utility Fluids

Suitable utility fluids typically comprise a mixture of multi-ring compounds. The rings can be aromatic or non-aromatic, and can contain a variety of substituents and/or heteroatoms. For example, a utility fluid can contain ring compounds in an amount ≥40.0 wt. %, ≥45.0 wt. %, ≥50.0 wt. %, ≥55.0 wt. %, or ≥60.0 wt. %, based on the weight of the utility fluid. In certain aspects, at least a portion of a utility fluid is obtained from a hydroprocessor effluent, e.g., by one or more separations. This can be carried out as disclosed in U.S. Pat. No. 9,090,836, which is incorporated by reference herein in its entirety.

Typically, a utility fluid comprises aromatic hydrocarbon, e.g., ≥25.0 wt. %, such as ≥40.0 wt. %, or ≥50.0 wt. %, or ≥55.0 wt. %, or ≥60.0 wt. % of aromatic hydrocarbon, based on the weight of the utility fluid. The aromatic hydrocarbon can include, e.g., one, two, and three ring aromatic hydrocarbon compounds. For example, the utility fluid can comprise ≥15 wt. % of 2-ring and/or 3-ring aromatics, based on the weight of the utility fluid, such as ≥20 wt. %, or ≥25.0 wt. %, or ≥40.0 wt. %, or ≥50.0 wt. %, or ≥55.0 wt. %, or ≥60.0 wt. %. Utilizing a utility fluid comprising aromatic hydrocarbon compounds having 2-rings and/or 3-rings is advantageous because utility fluids containing these compounds typically exhibit an appreciable $S_{BN}$. Suitable utility fluids typically have a significant solvency power, e.g., as indicated by an $S_{BN}$≥100, e.g., ≥120, but the invention is not limited to the use thereof. Such utility fluids typically contain a major amount of 2 to 4 ring aromatics, with some being partially hydrogenated.

A utility fluid typically has an A.S.T.M. D86 10% distillation point≥60° C. and a 90% distillation point≤425° C., e.g., ≤400° C. In certain aspects, the utility fluid has a true boiling point distribution with an initial boiling point≥130° C. (266° F.) and a final boiling point≤566° C. (1050° F.). In other aspects, the utility fluid has a true boiling point distribution with an initial boiling point≥150° C. (300° F.) and a final boiling point≤430° C. (806° F.). In still other aspects, the utility has a true boiling point distribution with an initial boiling point≥177° C. (350° F.) and a final boiling point≤425° C. (797° F.). True boiling point distributions (the distribution at atmospheric pressure) can be determined, e.g., by conventional methods such as the method of A.S.T.M. D7500. When the final boiling point is greater than that specified in the standard, the true boiling point distribution can be determined by extrapolation. A particular form of the utility fluid has a true boiling point distribution having an initial boiling point≥130° C. and a final boiling point≤566° C.; and/or comprises ≥15 wt. % of two ring and/or three ring aromatic compounds.

A tar-fluid mixture is produced by combining a pyrolysis tar, e.g., SCT, with a sufficient amount of a utility fluid for the tar-fluid mixture to have a viscosity that is sufficiently low for the tar-fluid mixture to be conveyed to hydroprocessing, e.g., a 50° C. kinematic viscosity of the tar-fluid mixture that is ≤500 cSt. The amounts of utility fluid and pyrolysis tar in the tar-fluid mixture to achieve such a viscosity are generally in the range of from about 20.0 wt. % to about 95.0 wt. % of the pyrolysis tar and from about 5.0 wt. % to about 80.0 wt. % of the utility fluid, based on total weight of tar-fluid mixture. For example, the relative amounts of utility fluid and pyrolysis tar in the tar-fluid mixture can be in the range of (i) about 20.0 wt. % to about 90.0 wt. % of the pyrolysis tar and about 10.0 wt. % to about 80.0 wt. % of the utility fluid, or (ii) from about 40.0 wt. % to about 90.0 wt. % of the pyrolysis tar and from about 10.0 wt. % to about 60.0 wt. % of the utility fluid. The utility fluid:pyrolysis tar weight ratio is typically ≥0.01, e.g., in the range of 0.05 to 4.0, such as in the range of 0.1 to 3.0, or 0.3 to 1.1. In certain aspects, particularly when the pyrolysis tar comprises a representative SCT, the tar-fluid mixture can comprise 50 wt. % to 70 wt. % of pyrolysis tar, with ≥90 wt. % of the balance of the tar-fluid mixture comprising the specified utility fluid, e.g., ≥95 wt. %, such as ≥99 wt. Although the utility fluid can be combined with the pyrolysis tar to produce the tar-fluid mixture within the hydroprocessing stage, it is typical to combine the pyrolysis tar and utility fluid upstream of the hydroprocessing, e.g., by adding utility fluid to the pyrolysis tar.

Typically, a utility fluid is combined with the tar being processed during a heat soaking process step that reduces the reactivity of the tar. (See, e.g. FIGS. 2 and 3, line 56 ("optional flux" inlet).) In some embodiments, the utility fluid is added to the tar after a heat soaking process step has been applied to the tar and before the process stream is fed into a solids-removal step. (This arrangement is not shown in the figures.)

Typically, the tar is combined with a utility fluid to produce a tar-fluid mixture. Mixing of compositions comprising hydrocarbons can result in precipitation of certain solids, for example asphaltenes, from the mixture. Hydrocarbon compositions that produce such precipitates upon mixing are said to be "incompatible." Creating an incompatible mixture can be avoided by mixing only compositions such that the "solubility blending number, $S_{BN}$, of all of the components of the mixture is greater than the "insolubility number", $I_N$, of all of the components of the mixture. Determining $S_{BN}$ and $I_N$ and so identifying compatible mixtures of hydrocarbon compositions is described in U.S. Pat. No. 5,997,723, incorporated by reference herein in its entirety.

In certain aspects the process includes treating (e.g., by mild hydroprocessing) a tar-fluid mixture in a guard reactor, and then carrying out the pretreatment under Pretreatment Hydroprocessing Conditions, where the feed to the pretreater comprises at least a portion of the guard reactor's effluent, e.g., a major amount of the guard reactor's effluent, such as substantially all of the guard reactor's effluent. These aspects typically feature one or more of (i) a utility fluid having an $S_{BN}$≥100, e.g., $S_{BN}$≥110; (ii) a pyrolysis tar having an $I_N$≥70, e.g., ≥80; and (iii)≥70 wt. % of the pyrolysis tar resides in compositions having an atmospheric boiling point≥290° C., e.g., ≥80 wt. %, or ≥90 wt. %. The tar-fluid mixture can have, e.g., an $S_{BN}$≥110, such as ≥120, or ≥130. It has been found that there is a beneficial decrease in reactor plugging, particularly in the guard reactor and/or pretreater, when the tar feed has an $I_N$>110 provided that, after being combined with the utility fluid, the feed has an $S_{BN}$≥150, ≥155, or ≥160. The pyrolysis tar can have a relatively large $I_N$, e.g., $I_N$>80, especially >100, or >110, provided the utility fluid has relatively large $S_{BN}$, e.g., ≥100, ≥120, or ≥140.

Figure 2:
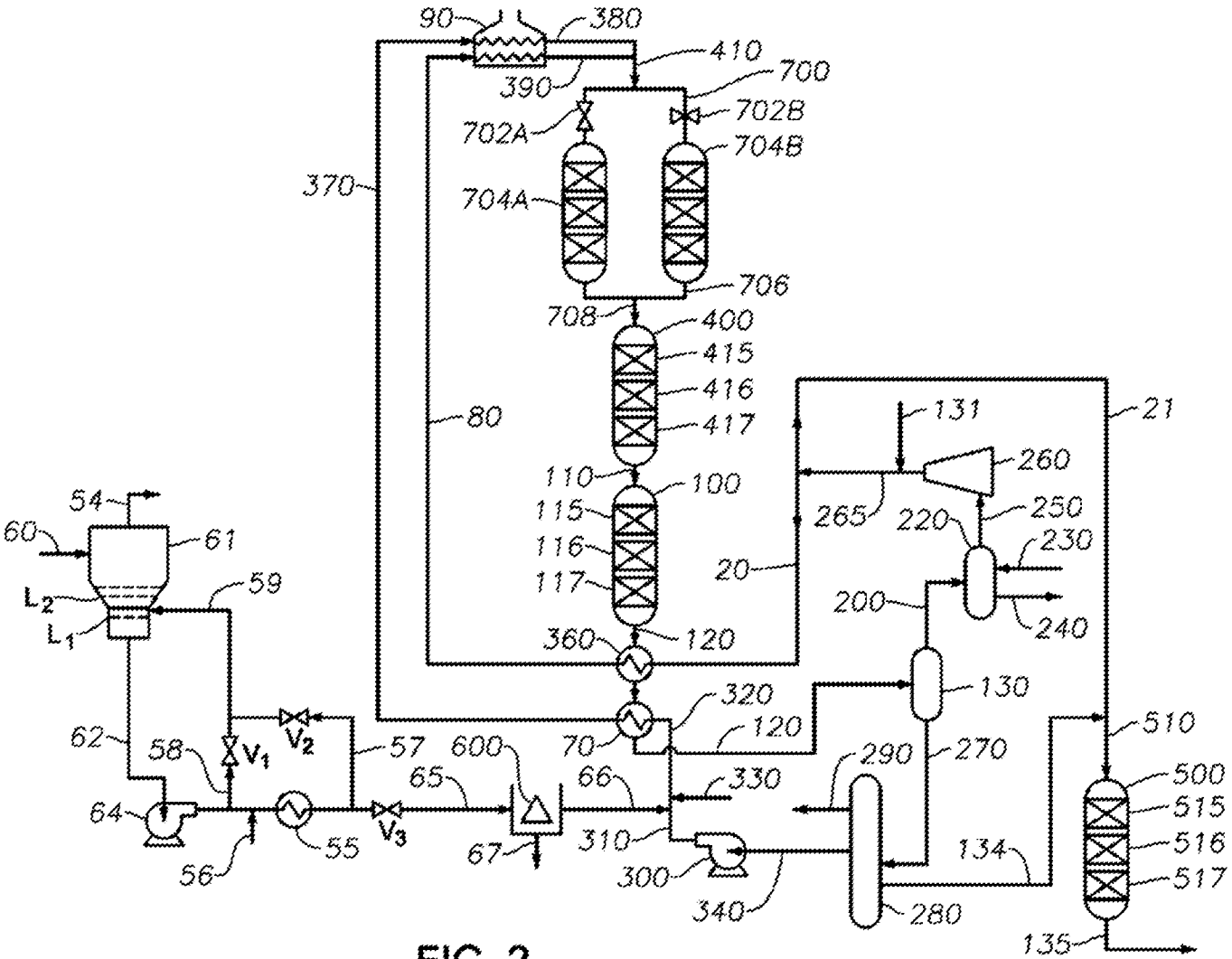
FIG. 2 shows a more detailed schematic of the tar processing method as disclosed herein.
Figure 3:
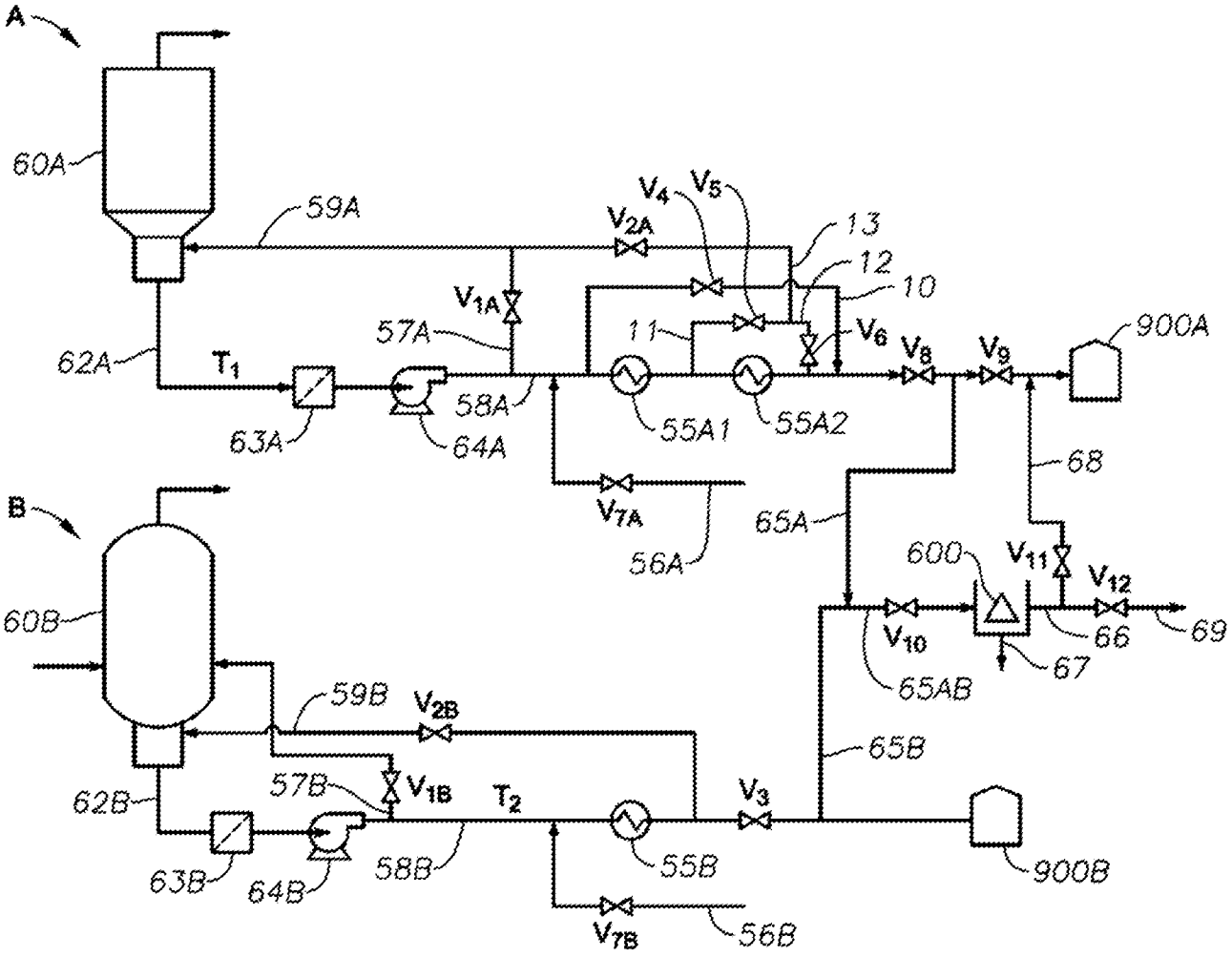
FIG. 3 shows an alternative cold tar-recycle arrangement that can be used for heat soaking the tar feed, in which tar produced by two different upstream processes can be treated.

Referring now to FIGS. 1-3, the process flow of the tar upgrading process is described in more detail.

The tar upgrading process includes steps of hydroprocessing, typically such that a later step of hydroprocessing is conducted under similar or more severe conditions than an earlier step of hydroprocessing. Thus, at least one stage of hydroprocessing under "Pretreatment Hydroprocessing Conditions", to lower the reactivity of the tar or of the tar-utility fluid mixture. The pretreatment hydroprocessing is carried out before a stage of hydroprocessing that is carried out under Intermediate Hydroprocessing Conditions. The intermediate hydroprocessing typically effects the major part of hydrogenation and some desulfurizing reactions. Pretreatment Hydroprocessing Conditions are less severe than "Intermediate Hydroprocessing Conditions". For example, compared to Intermediate Hydroprocessing Conditions, Pretreatment Hydroprocessing Conditions utilize one or more of a lesser hydroprocessing temperature, a lesser hydroprocessing pressure, a greater feed (tar+utility fluid) WHSV, a greater pyrolysis tar WHSV, and a lesser molecular hydrogen consumption rate. Within the parameter ranges (T, P, WHSV, etc.) specified for Pretreatment Hydroprocessing Conditions, particular hydroprocessing conditions can be selected to achieve a desired 566° C.+ conversion, typically in the range of from 0.5 wt. % to 5 wt. % substantially continuously for at least ten days.

Optionally, the process includes at least one stage of retreatment hydroprocessing, especially to further lessen sulfur content of the intermediate hydroprocessed tar. Retreatment hydroprocessing is carried out under "Retreatment Hydroprocessing Conditions" after at least one stage of hydroprocessing under Intermediate Hydroprocessing Conditions. Typically, the retreatment hydroprocessing is carried out with little or no utility fluid. The Retreatment Hydroprocessing Conditions are typically more severe than the Intermediate Hydroprocessing Conditions, When a temperature is indicated for particular catalytic hydroprocessing conditions in a hydroprocessing zone, e.g., Pretreatment, Intermediate, and Retreatment Hydroprocessing Conditions, this refers to the average temperature of the hydroprocessing zone's catalyst bed (one half the difference between the bed's inlet and outlet temperature). When the hydroprocessing reactor contains more than one hydroprocessing zone (e.g., as shown in FIG. 2) the hydroprocessing temperature is the average temperature in the hydroprocessing reactor, e.g., (one half the difference between the temperature of the most upstream catalyst bed's inlet and the temperature of the most downstream catalyst bed's outlet temperature).

Total pressure in each of the hydroprocessing stage is typically regulated to maintain a flow of pyrolysis tar, pyrolysis tar composition, pretreated tar, hydroprocessed tar, and retreated tar from one hydroprocessing stage to the next, e.g., with little or need for inter-stage pumping. Although it is within the scope of the invention for any of the hydroprocessing stages to operate at an appreciably greater pressure than others, e.g., to increase hydrogenation of any thermally-cracked molecules, this is not required. The invention can be carried out using a sequence of total pressure from stage-to-stage that is sufficient (i) to achieve the desired amount of tar hydroprocessing, (ii) to overcome any pressure drops across the stages, and (iii) to maintain tar flow to the process, from stage-to-stage within the process, and away from the process.

A: Thermal Treatment to Reduce Tar Reactivity to <28 BN

Formation of coke precursors during pyrolysis tar hydroprocessing leads to an increase in hydroprocessing reactor fouling. It has been observed that coke precursor formation results mainly from two reactions: inadequate hydrogenation of thermally cracked molecules and polymerization of highly reactive molecules in the pyrolysis tar. Although inadequate hydrogenation can be addressed by increasing the reactor pressure, the polymerizations of highly reactive molecules depend not only on pressure, but mainly on other conditions such as temperature and weight hourly space velocity ("WHSV"). Accordingly, certain aspects of the invention relate to carrying out pyrolysis tar hydroprocessing with less reactor fouling by (i) thermally-treating the tar which produces a tar composition having a lesser reactivity, (ii) hydroprocessing of the thermally-treated tar in the presence of a utility fluid to form a pretreater effluent, and (iii) hydroprocessing of the pretreater effluent to produce a hydroprocessed tar.

Reactivities such as pyrolysis tar reactivity $R_T$, pyrolysis tar composition reactivity $R_C$, and reactivity of the tar-fluid mixture $R_M$ have been found to be well-correlated with the tar's olefin content, especially the content of styrenic hydrocarbons and dienes. While not wishing to be bound by any particular theory, it is believed that the pyrolysis tar's olefin compounds (i.e., the tar's olefin components) have a tendency to polymerize during hydroprocessing, leading to the formation of coke precursors that are capable of plugging or otherwise fouling the reactor. Fouling is more prevalent in the absence of hydrogenation catalysts, such as in the preheater and dead volume zones of a hydroprocessing reactor. Certain measures of a tar's olefin content, e.g., BN, have been found to be well-correlated with the tar's reactivity. Reactivities such as $R_T$, $R_C$, and $R_M$ can therefore be expressed in BN units, i.e., the amount of bromine (as $Br_2$) in grams consumed (e.g., by reaction and/or sorption) by 100 grams of a tar sample. Bromine Index ("BI") can be used instead of or in addition to BN measurements, where BI is the amount of $Br_2$ mass in mg consumed by 100 grams of tar.

Pyrolysis tar reactivity can be measured using a sample of the pyrolysis tar withdrawn from a pyrolysis tar source, e.g., bottoms of a flash drum separator, a tar storage tank, etc. The sample is combined with sufficient utility fluid to achieve a predetermined 50° C. kinematic viscosity in the tar-fluid mixture, typically ≤500 cSt. Although the BN measurement can be carried out with the tar-fluid mixture at an elevated temperature, it is typical to cool the tar-fluid mixture to a temperature of about 25° C. before carrying out the BN measurement. Conventional methods for measuring BN of a heavy hydrocarbon can be used for determining pyrolysis tar reactivity, or that of a tar-fluid mixture, but the invention is not limited to using these. For example, BN of a tar-fluid mixture can be determined by extrapolation from conventional BN methods as applied to light hydrocarbon streams, such as electrochemical titration, e.g., as specified in A.S.T.M. D-1159; colorimetric titration, as specified in A.S.T.M. D1158; and Karl Fischer titration. Typically, the titration is carried out on a tar sample having a temperature≤ambient temperature, e.g., ≤25° C. Although the cited A.S.T.M. standards are indicated for samples of lesser boiling point, it has been found that they are also applicable to measuring pyrolysis tar BN. Suitable methods for doing so are disclosed by D. J. Ruzicka and K. Vadum in Modified Method Measures Bromine Number of Heavy Fuel Oils, Oil and Gas Journal, Aug. 3, 1987, 48-50; which is incorporated by reference herein in its entirety. Iodine number measurement (using, e.g., A.S.T.M. D4607 method, WIJS Method, or the Hübl method) can be used as an alternative to BN for determining pyrolysis tar reactivity. BN may be approximated from Iodine Number by the formula:

$$BN \sim \text{Iodine Number}^{*}(\text{Atomic Weight of } I_2)/(\text{Atomic Weight of } Br_2).$$

Certain aspects of the invention include thermally-treating a tar to produce a thermally-treated tar (a tar composition, e.g., a pyrolysis tar composition), combining the tar composition with utility fluid to produce a tar-fluid mixture, hydroprocessing the tar-fluid mixture under Pretreatment Hydroprocessing Conditions to produce a pretreater effluent, and hydroprocessing at least part of the pretreatment effluent under Intermediate Hydroprocessing Conditions to produce a hydroprocessor effluent comprising hydroprocessed tar. For example, the process can include thermally treating a SCT to produce a SCT composition, combining the SCT composition with a specified amount of a specified utility fluid to produce a tar-fluid mixture, hydroprocessing the tar-fluid mixture in a pretreatment reactor under Pretreatment Hydroprocessing Conditions, to produce a pretreater effluent, and hydroprocessing at least a portion of the pretreater effluent under Intermediate Hydroprocessing.

In addition to its high density and high sulfur content, tar is very reactive because it contains a significant amount of reactive olefins, such as vinyl naphthalenes, acenaphthalenes, etc. Uncontrolled oligomerization reactions lead to fouling in a preheater and/or a reactor when tar is heated, e.g. to temperatures greater than 250° C. The higher the temperature, the more severe the fouling. In the present process, the tar feed is subjected to an initial, controlled heat-soaking step to oligomerize olefins in the tar and thereby decrease the reactivity of the tar during further processing (e.g. Scheme 1 below).

Scheme 1

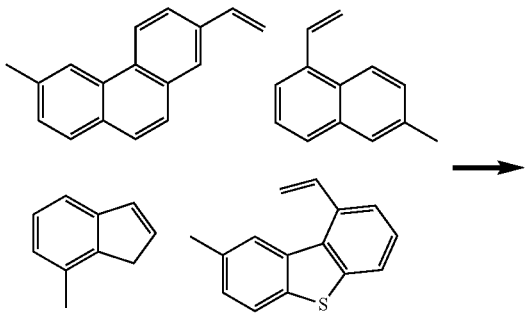

-continued

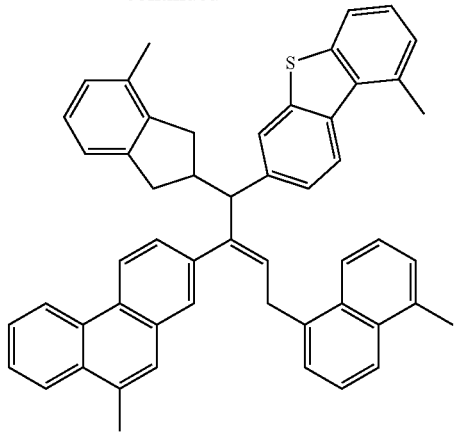

Certain aspects of the thermal treatment (e.g., heat soaking) are described below in more detail with respect to a representative pyrolysis tar. The invention is not limited to these aspects, and this description is not meant to foreclose other thermal treatments within the broader scope of the invention.

Thermally treating a tar to reduce its reactivity can be accomplished in a cold tar recycling process with some minor modification, e.g. by reducing the flow of cold tar back into the process as described further below. Thermal treatment kinetics suggests that a reaction temperature of 200° C. to 300° C. with a residence time of a few minutes, e.g. 2 min., to >30 min., are effective in reducing tar reactivity. The higher the thermal treating temperature, the shorter the thermal treatment reaction time or residence time can be. For example, at 300° C., a residence time of 2-5 minutes may be adequate. At 250° C., a residence time of ~30 min gives similar reduction in reactivity. Pressure has little impact on thermal treatment kinetics and so the thermal treatment can be performed at ambient pressure or at the pressure of the outlet of the tar knockout process feeding the presently disclosed tar upgrading process.

Typically, tar reactivity is ≥30 BN, e.g., in the range of from 30 BN to as high as 40 BN or greater. A target reactivity of 28 BN or lower is set in order to decrease (or even minimize) fouling in the guard reactor and/or pretreater, which typically utilizes a hydroprocessing temperature in the range of from 260° C. to 300° C. Providing a heat-soaked tar (a tar composition of reactivity $R_C$) as feed to the guard reactor operating in the specified guard reactor temperature range for guard reactor hydroprocessing typically results in little if any fouling of the guard reactor for typical hydroprocessing run durations. Tar dilution with utility fluid (as a solvent or flux) should be minimized prior to or during heat soaking. In some instances it may be necessary to inject utility fluid to improve tar flow characteristics during and after heat soaking. However, excessive dilution with utility fluid leads to much slower reduction in tar BN during the heat soaking. Thus, it is desirable that the amount of utility fluid utilized used for viscosity reduction during thermal treatment (heat soaking) be controlled to ≤10 wt. % based on the combined weight of tar and utility fluid.

FIG. 2 includes an exemplary cold tar recycle system (i.e. elements upstream of the centrifuge element 600). FIG. 3 shows an alternative arrangement of the cold tar recycle system in which tar streams from two separate upstream processes are recycled separately and then can be combined for solids removal and subsequent downstream processing.

Cold tar recycle is designed to reduce tar residence time at high temperature, such as at a tar knockout drum temperature, which is typically around 300° C. In existing tar disposition, cold tar recycle is implemented to reduce oligomerization to minimize increase in asphaltene content, which requires addition of expensive flux, such as steam cracked gas oil, in order to be blended into HSFO. In order to heat soak tar to reduce tar BN, cold tar recycle is minimized, e.g. by lowering the recycle tar flow rate, to increase tar temperature and also increase residence time. By reducing the cold tar recycle to a flow rate of 0 to 100 tons per hour, heat soaking is carried out in a temperature range of from 200° C. to 300° C., typically 250° C. to 280° C., for a heat soaking time in the range of from 2 to 15 minutes. Additional heat soaking, in which the tar is held at elevated temperatures, such as 150° C. or higher, for an extended time, e.g. from 0.5 to 2 hours, should reduce the BN even further, for example to 25, or 23, or less but may for certain tars, e.g., certain SCTs, lead to an IC increase. In certain aspects, the thermal treatment is carried out at a temperature in the range of from 20° C. to 300° C., or from 200° C. to 250° C. or from 225° C. to 275° C., for a time in the range of from 2 to 30 minutes, e.g., 2 to 5 minutes, or 5 to 20 minutes or 10 to 20 minutes. At higher temperatures, the heat soaking can be suitably be performed for a shorter period of time.

For representative tars, e.g., representative pyrolysis tars, such as representative SCTs, it is observed that the specified thermal treatment, e.g., the specified neat soaking carried out by cold tar recycle, decreases one or more of $R_T$, $R_C$, and $R_M$. Typically, the thermal treatment is carried out using a pyrolysis tar feed of reactivity $R_T$ to produce a pyrolysis tar composition having a lesser reactivity=$R_C$. Conventional thermal treatments are suitable for heat treating pyrolysis tar, including heat soaking, but the invention is not limited thereto. Although reactivity can be improved by blending the pyrolysis tar with a second pyrolysis tar of lesser olefinic hydrocarbon content, it is more typical to improve $R_T$ (and hence $R_M$) by thermal treatment of the pyrolysis tar. It is believed that the specified thermal treatment is particularly effective for decreasing the tar's olefin content. For example, combining a thermally-treated SCT with the specified utility fluid in the specified relative amounts typically produces a tar-fluid mixture having an $R_M \leq 18$ BN. If substantially the same SCT is combined with substantially the same utility fluid in substantially the same relative amounts without thermally-treating the tar, the tar-fluid mixture typically has an $R_M$ in the range of from 19 BN to 35 BN.

One representative pyrolysis tar is an SCT ("SCT1") having an $R_T$>28 BN (on a tar basis), such as $R_T$ of about 35; a density at 15° C. that is ≥1.10 g/cm$^3$; a 50° C. kinematic viscosity in the range of ≥1.0×10$^4$ cSt; an $I_N$>80; wherein ≥70 wt. % of SCT1's hydrocarbon components have an atmospheric boiling point of ≥290° C. SCT1 can be obtained from an SCT source, e.g., from the bottoms of a separator drum (such as a tar drum) located downstream of steam cracker effluent quenching. The thermal treatment can include maintaining SCT1 to a temperature in the range of from $T_1$ to $T_2$ for a time≥$t_{HS}$. $T_1$ is ≥150° C., e.g., ≥160° C., such as ≥170° C., or ≥180° C., or ≥190° C., or ≥200° C. $T_2$ is ≤320° C., e.g., ≤310°, such as ≤300° C., or ≤290° C., and $T_2$ is ≥$T_1$. Generally, $t_{HS}$ is ≥1 min., e.g., ≥10 min., such as ≥100 min., or typically in the range of from 1 min. to 400 min. Provided $T_2$ is ≤320° C., utilizing a $t_{HS}$ of ≥10 min., e.g., ≥50 min, such as ≥100 min. typically produces a treated tar having better properties than those treated for a lesser $t_{HS}$.

Although the invention is not so limited, the heating can be carried out in a lower section of the tar drum and/or in SCT piping and equipment associated with the tar knock out drum. For example, it is typical for a tar drum to receive quenched steam cracker effluent containing SCT. While the steam cracker is operating in pyrolysis mode, SCT accumulates in a lower region of the tar drum, from which the SCT is continuously withdrawn. A portion of the withdrawn SCT can be reserved for measuring one or more of $R_T$ and $R_M$. The remainder of the withdrawn SCT can be conducted away from the tar drum and divided into two separate SCT streams. At least a portion of the first stream (a recycle portion) is recycled to the lower region of the tar drum. At least a recycle portion of the second stream is also recycled to the lower region of the tar drum, e.g., separately or together with the recycle portion of the first stream. Typically, ≥75 wt. % of the first stream resides in the recycled portion, e.g., ≥80 wt. %, or ≥90 wt. %, or ≥95 wt. %. Typically, ≥40 wt. % of the second stream resides in the recycled portion, e.g., ≥50 wt. %, or ≥60 wt. %, or ≥70 wt. %. Optionally, a storage portion is also divided from the second stream, e.g., for storage in tar tanks. Typically, the storage portion is ≥90 wt. % of the remainder of the second stream after the recycle portion is removed. The thermal treatment temperate range and $t_{HS}$ can be controlled by regulating flow rates to the tar drum of the first and/or second recycle streams.

Typically, the recycle portion of the first stream has an average temperature that is no more than 60° C. below the average temperature of the SCT in the lower region of the tar drum, e.g., no more than 50° C. below, or no more than 25° C. below, or no more than 10° C. below. This can be achieved, e.g., by thermally insulating the piping and equipment for conveying the first stream to the tar drum. The second stream, or the recycle portion thereof, is cooled to an average temperature that is (i) less than that of the recycle portion of the first stream and (ii) at least 60° C. less than the average temperature of the SCT in the lower region of the tar drum, e.g., at least 70° C. less, such as at least 80° C. less, or at least 90° C. less, or at least 100° C. less. This can be achieved by cooling the second stream, e.g., using one or more heat exchangers. Utility fluid can be added to the second stream as a flux if needed. If utility fluid is added to the second stream, the amount of added utility fluid flux is taken into account when additional utility fluid is combined with SCT to produce a tar-fluid mixture to achieve a desired tar:fluid weight ratio within the specified range.

The thermal treatment is typically controlled by regulating (i) the weight ratio of the recycled portion of the second stream:the withdrawn SCT stream and (ii) the weight ratio of the recycle portion of the first stream:recycle portion of the second stream. Controlling one or both of these ratios has been found to be effective for maintaining and average temperature of the SCT in the lower region of the tar drum in the desired ranges of $T_1$ to $T_2$ for a treatment time $t_{HS}$≥1 minute. A greater SCT recycle rate corresponds to a greater SCT residence time at elevated temperature in the tar drum and associated piping, and typically increases the height of the tar drum's liquid level (the height of liquid SCT in the lower region of the tar drum, e.g., proximate to the boot region). Typically, the ratio of the weight of the recycled portion of the second stream to the weight of the withdrawn SCT stream is ≤0.5, e.g., ≤0.4, such as ≤0.3, or ≤0.2, or in the range of from 0.1 to 0.5. Typically, the weight ratio of the recycle portion of the first stream:recycle portion of the second stream is ≤5, e.g., ≤4, such as ≤3, or ≤2, or ≤1, or ≤0.9, or ≤0.8, or in the range of from 0.6 to 5. Although it is not required to maintain the average temperature of the SCT in the lower region of the tar drum at a substantially constant value ($T_{HS}$), it is typical to do so. $T_{HS}$ can be, e.g., in the range of from 150° C. to 320° C., such as 160° C. to 310°, or ≥170° C. to 300° C. In certain aspects, the thermal treatment conditions include (i) $T_{HS}$ is at least 10° C. greater than $T_1$ and (ii) $T_{HS}$ is in the range of 150° C. to 320° C. For example, typical $T_{HS}$ and $t_{HS}$ ranges include 180° C.≤$T_{HS}$≤320° C. and 5 minutes≤$t_{HS}$≤100 minutes; e.g., 200° C.≤$T_{HS}$≤280° C. and 5 minute≤$t_{HS}$≤30 minutes. Provided $T_{HS}$ is ≤320° C., utilizing a $t_{HS}$ of ≥10 min., e.g., ≥50 min, such as ≥100 min typically produces a better treated tar over those produced at a lesser $t_{HS}$.

The specified thermal treatment is effective for decreasing the representative SCTs $R_T$ to achieve an $R_C \leq R_T - 0.5$ BN, e.g., $R_C \leq R_T - 1$ BN, such as $R_C \leq R_T - 2$ BN, or $R_C \leq R_T - 4$ BN, or $R_C \leq R_T - 8$ BN. Since $R_C \leq 18$ BN, $R_M$ is typically ≤18 BN, e.g., ≤17 BN, such as 12 BN≤$R_M$≤18 BN. In certain aspects, the thermal treatment results in the tar-fluid mixtures having an $R_M$≤17 BN, e.g., ≤16 BN, such as ≤12 BN, or ≤10 BN, or ≤8 BN. Carrying out the thermal treatment at a temperature in the specified temperature range of $T_1$ to $T_2$ for the specified time $t_{HS}$≥1 minute is beneficial in that the treated tar (the pyrolysis tar composition) has an insolubles content ("$IC_C$") that is less than that of a treated tar obtained by thermal treatments carried out at a greater temperature. This is particularly the case when $T_{HS}$ is ≤320° C., e.g., ≤300° C., such as ≤250° C., or ≤200° C., and $t_{HS}$ is ≥10 minutes, such as ≥100 minutes. The favorable $IC_C$ content, e.g. ≤6 wt. %, and typically ≤5 wt. %, or ≤3 wt. %, or ≤2 wt. %, increases the suitability of the thermally-treated tar for use as a fuel oil, e.g., a transportation fuel oil, such as a marine fuel oil. It also decreases the need for solids-removal before hydroprocessing. Generally, $IC_C$ is about the same as or is not appreciably greater $IC_T$. $IC_C$ typically does not exceed $IC_T$+3 wt. %, e.g., $IC_C \leq IC_T$+2 wt. %, such as $IC_C \leq IC_T$+1 wt. %, or $IC_C \leq IC_T$+0.1 wt. %.

Although it is typical to carry out SCT thermal treatment in one or more tar drums and related piping, the invention is not limited thereto For example, when the thermal treatment includes heat soaking, the heat soaking can be carried out at least in part in one or more soaker drums and/or in vessels, conduits, and other equipment (e.g. fractionators, water-quench towers, indirect condensers) associated with, e.g., (i) separating the pyrolysis tar from the pyrolysis effluent and/or (ii) conveying the pyrolysis tar to hydroprocessing. The location of the thermal treatment is not critical. The thermal treatment can be carried out at any convenient location, e.g., after tar separation from the pyrolysis effluent and before hydroprocessing, such as downstream of a tar drum and upstream of mixing the thermally treated tar with utility fluid.

In certain aspects, the thermal treatment is carried out as illustrated schematically in FIG. 2. As shown, quenched effluent from a steam cracker furnace facility is conducted via line 60 to a tar knock out drum 61. Cracked gas is removed from the drum via line 54. SCT condenses in the lower region of the drum (the boot region as shown), and a withdrawn stream of SCT is conducted away from the drum via line 62 to pump 64. A filter (not shown in the figure) for removing large solids, e.g. ≥10,000 μm diameter, from the SCT stream may be included in the line 62. After pump 64, a first recycle stream 58 and a second recycle stream 57 are diverted from the withdrawn stream. The first and second recycle streams are combined as recycle to drum 61 via line 59. One or more heat exchangers 55 is provided for cooling the SCT in lines 57 (shown) and 65 (not shown) e.g., against water. Line 56 provides an optional flux of utility fluid if needed. Valves $V_1$, $V_2$, and $V_3$ regulate the amounts of the withdrawn stream that are directed to the first recycle stream, the second recycle stream, and a stream conducted to solids separation, represented here by centrifuge 600, via line 65. Lines 58, 59, and 62 can be insulated to maintain the temperature of the SCT within the desired temperature range for the thermal treatment. The thermal treatment time $t_{HS}$ can be increased by increasing SCT flow through valves $V_1$ and $V_2$, which raises the SCT liquid level in drum 61 from an initial level, e.g., $L_1$, toward $L_2$.

Thermally-treated SCT is conducted through valve $V_3$ and via line 65 toward a solids removal facility, here a centrifuge 600, and then the liquid fraction from the centrifuge is conveyed via line 66 to a hydroprocessing facility comprising at least one hydroprocessing reactor. Solids removed from the tar are conducted away from the centrifuge via line 67. In the aspects illustrated in FIG. 2 using a representative SCT such as SCT1, the average temperature $T_{HS}$ of the SCT during thermal treatment in the lower region of tar drum (below $L_2$) is in the range of from 200° C. to 275° C., and heat exchanger 55 cools the recycle portion of the second stream to a temperature in the range of from 60° C. to 80° C. Time $T_{HS}$ can be, e.g., ≥10 min., such as in the range of from 10 min. to 30 min., or 15 min to 25 min.

In continuous operation, the SCT conducted via line 65 typically comprises ≥50 wt. % of SCT available for processing in drum 61, such as SCT, e.g., ≥75 wt. %, such as ≥90 wt. %. In certain aspects, substantially all of the SCT available for hydroprocessing is combined with the specified amount of the specified utility fluid to produce a tar-fluid mixture which is conducted to hydroprocessing. Depending, e.g., on hydroprocessor capacity limitations, a portion of the SCT in line 65 or line 66 can be conducted away, such as for storage or further processing, including storage followed by hydroprocessing (not shown).

FIG. 3 shows an alternative arrangement in which tars from two separate pyrolysis processes can be heat soaked in separate recycling processes and then combined for solids removal. A first process A includes a separation in a tar knockout drum 60A. The lights are removed overhead of the drum, as shown, e.g., for further separation in at least one fractionator. A bottoms fraction comprising a pyrolysis tar is removed from drum 60A via line 62A through a filter 63A for removal of large solids, e.g. ≥10,000 μm diameter, to pump 64A. After pump 64A, a first recycle stream 58A and a second recycle stream 57A (which bypasses the heat exchangers in stream 58A) are diverted from the withdrawn stream. The first recycle stream is passed through a heat exchanger 55A1 and optionally one or more further heat exchangers 55A2 before recombining with stream 57A via lines 12 and 13 as recycle to drum 61A via line 59A. Heat exchanger(s) 55A2 can be bypassed via lines 11 and 13 and appropriate configuration of valves V5 and V6. Both of heat exchangers 55A1 and 55A2 can be bypassed and the thermally processed tar stream can be conducted to downstream process steps via line 10 and appropriate configuration of valves V4, V5 and V6. Thermally processed tar from process A can be sent to downstream process steps via line 65A and/or to storage (in tank 900A) by appropriate configuration of valves V8 and V9. The proportion of recycle through the heat exchangers and bypassing them can be regulated by appropriate configuration of valves V1A and V2A. Line 56A and valve V7A can be configured to provide an optional flux of utility fluid if needed. A second process B includes a pyrolysis step includes a separation by fractionation, e.g., in a primary fractionator 60B. The lights are removed overhead of the primary fractionator as shown, e.g., to a secondary fractionator. The bottoms of fractionator 60B comprising a pyrolysis tar, is removed from primary fractionator 60B via line 62B through a filter 63B for removal of large solids, e.g. ≥10,000 μm diameter, to pump 64B. After pump 64B, a first recycle stream 58B and a second recycle stream 57B (which bypasses the heat exchangers in stream 58B) are diverted from the withdrawn stream. The first recycle stream is passed through a heat exchanger 55B and optionally one or more further heat exchangers (not shown) before recycling to the bottoms collector of the fractionator 60B via line 59B through valve V2B. The second recycle stream recycles via valve V1B to the fractionator. The proportion of recycle through the primary fractionator and through the fractionator bottoms collector is regulated by appropriate configuration of valves V1B and V2B. Line 56B and valve V7B can be configured to provide an optional flux of utility fluid if needed. Valve V3 controls the flow from the thermal treatment process to the solids removal facility (here centrifuge 600), via line 65B and/or to storage (in tank 900B).

In the thermal treatment of the tar produced in process A, a temperature T1 is shown, and the temperature of the thermal treatment of the tar produced in process B is shown as T2. T1 and T2 can be the same or different, and are chosen appropriately for the particular tar to be thermally treated and the desired residence time for the thermal treatment. For example, T1 for a pyrolysis tar obtained from a tar knockout drum might be 250° C. or so, and T2, for a pyrolysis tar obtained from the bottoms of a primary fractionator, might be 280° C. or so.

In FIG. 3, lines 58A, 58B, 59A, 59B, and 62A and 62B can be insulated to maintain the temperature of the SCT within the desired temperature range for the thermal treatment.

Downstream of the joinder of lines 65A and 65B, valve V10 regulates the amounts of the thermally processed tar that is fed to a solids removal step; here solids are removed by the centrifuge 600.

B: Centrifugation to Remove Solids Having a Size of about 25 μm or Larger

Tar such as SCT, contains 1000 ppmw to up to 4000 ppmw or even greater amounts of insolubles in the form of particulate solids. The particles are believed to have two origins. The first source is coke fines arising from pyrolysis. The coke fines from pyrolysis typically have very low hydrogen content, e.g., ≤3 wt. %, and a density≥1.2 g/ml. The second source is from tar oligomerization or polymer coke. There are multiple points in the steam cracking process that polymer coke can form and enter the tar stream. For example, some steam crackers have significant fouling issues in a primary fractionator. The source of this fouling is believed to result from polymers forming in the fractionator tower via vinyl aromatics oligomerization at temperatures≤150° C. Although it is conventional to periodically remove foulant from fractionator trays by hydro-blasting, some foulant becomes entrained in the tar stream via the quench oil recycle. This foulant, identified herein as polymer coke, is richer in hydrogen content, e.g., ≥5 wt. %, and typically has lower density, e.g., ≤1.1 g/ml, than pyrolysis coke fines.

In addition to the two main sources of coke fines, a tertiary fines source is believed to result from the specified heat soaking. Accordingly it is within the scope of the invention to carry out the heat soaking under relatively mild conditions (lower temperature, shorter time durations) within the specified heat soaking conditions. Compared to solids produced by other pathways, solids produced during tar heat soaking are believed to have a relatively large hydrogen content (e.g., ≥5 wt. %), and are believed to have much smaller particle sizes, e.g., ≤25 μm.

Figure 4:
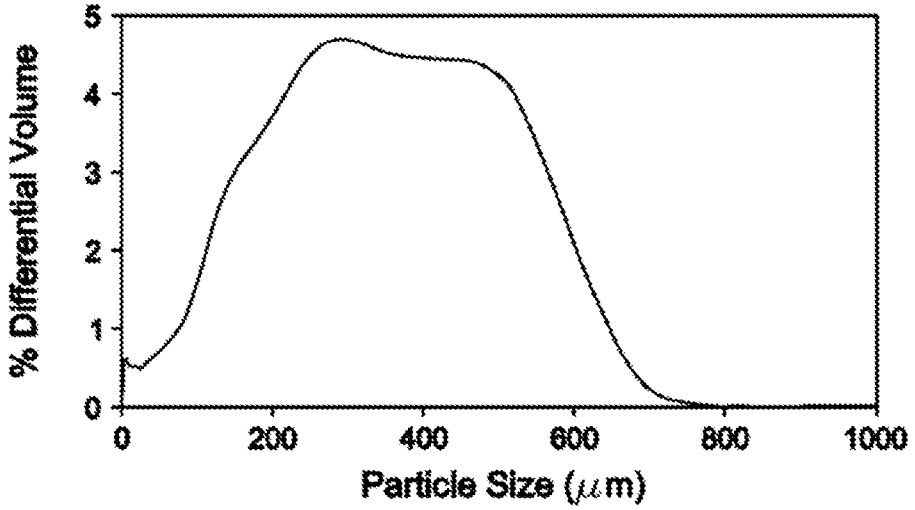
FIG. 4 shows a typical particle size distribution for tar solids.

FIG. 4 shows a typical particle size distribution of tar solids. Particle size ranges from submicron to 800 μm or larger. In addition to the indicated thermal treatment, the pyrolysis tar is optionally treated to remove solids, particularly those having a particle size>10,000 μm. Solids can be removed before and/or after the thermal treatment. For example, the tar can be thermally-treated and combined with utility fluid to form a tar-fluid mixture from which the solids are removed. Alternatively or in addition, solids can be removed before or after any hydroprocessing stage. Although it is not limited thereto, the invention is compatible with use of conventional solid-removal technology such as that disclosed in U.S. Patent Application Publication No. 2015-0361354, which is incorporated by reference herein in its entirety.

In certain aspects, centrifugation (typically assisted by the utility fluid) is used for solids removal. For example, solids can be removed from the tar-fluid mixture at a temperature in the range of from 80° C. to 100° C. using a centrifuge. Any suitable centrifuge may be used, including those industrial-scale centrifuges available from Alfa Laval. The feed to the centrifuge may be a tar-fluid mixture comprising utility fluid and a tar composition (thermally-treated tar). The amount of utility fluid is controlled such that the density of tar-fluid mixture at the centrifugation temperature, typically 50° C. to 120° C., or from 60° C. to 100° C., or from 60° C. to 90° C., is substantially the same as the desired feed density (1.02 g/ml to 1.06 to g/ml at 80° C. to 90° C.). Typically, the utility fluid comprises, consists essentially of, or even consists of a mid-cut stream separated from a product of tar hydroprocessing. For example, all or a part of the mid-cut stream can be obtained from the downstream utility fluid recovery step of the presently disclosed process. The amount of utility fluid in the tar-fluid mixture is typically around 40 wt. % for a wide variety of pyrolysis tars, but can vary, for example from 20% to 60%, so as to provide the feed at a desired density, which may be pre-selected.

Continuing with FIG. 2, the thermally treated tar stream is conducted via line 65 through valve V3 into a centrifuge 600. The liquid product is conducted via line 66 storage and/or the specified hydroprocessing. At least a portion of solids removed during centrifuging are conducted away via line 67, e.g., for storage or further processing.

Similarly in FIG. 3, the thermally treated tar stream from process A via line 65A and the thermally treated tar stream from process B via line 65B are combined in line 65AB and conducted to the centrifuge 600 via valve V10. The liquid product is conducted via lines 66 and 69 to downstream hydroprocessing facilities. The solid product is removed via line 67, which can be conducted away. Line 68 conveys the centrifuge liquid product to storage. Allocation of the centrifuge liquid product to storage or to further downstream processing is controlled by configuration of valves V11 and V12.

The centrifuge typically operates at 2000*g to 6000*g at a temperature in the range of from 50° C. to 125° C., or from 70° C. to 110° C., or from 70° C. to 100° C. or from 70° C. to 95° C., where "g" is acceleration due to gravity. A higher centrifugation temperature tends to allow for cleaner separation of solids from the tar. When the feed to the centrifuge contains 20-50 wt. % solids, and the centrifugation is typically performed at a temperature in the range of from 80° C. to 100° C. and a force of 2000×g to 6000×g.

Figure 5:
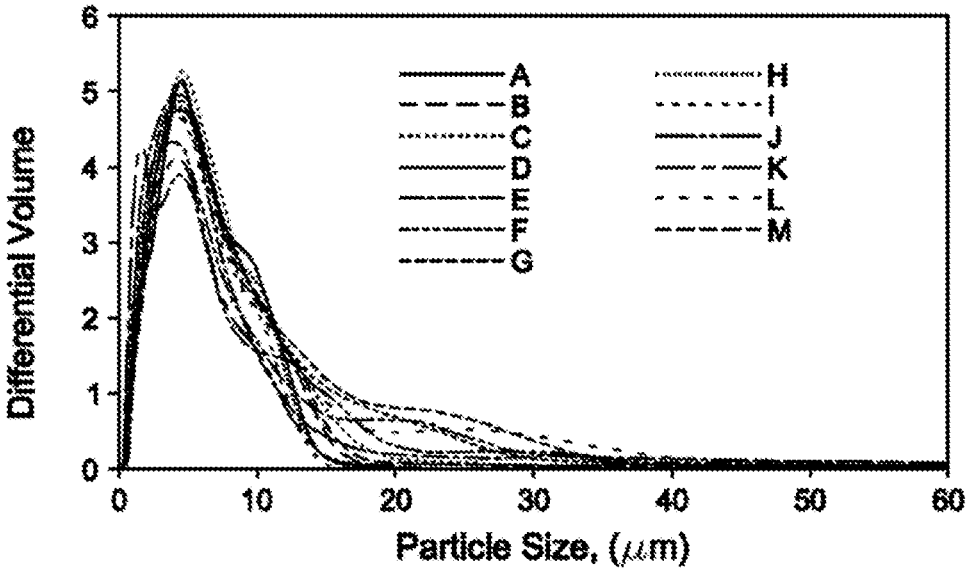
FIG. 5 shows the particle size distribution in effluent from centrifugation of representative heat soaked tar samples.

The centrifuge is effective in removing particulates from the feed, particularly those of size≥25 μm. The amount of particles≥25 μm in the centrifuge effluent is typically less than 2 vol. % of all the particles. Tar, e.g., pyrolysis tar, such as SCT, typically contains a relatively large concentration of particles having a size<25 μm. For representative tars, the amount of solids generally ranges from 100 ppm to 170 ppm with a median concentration of 150 ppm. As shown in FIG. 5 for repetitive SCTs A-M, a majority of the solids in each tar is in the form of particles having a size of <25 μm. Particles of such small size appear to be carried through the instant process without significant fouling.

Following the removal of solids, the tar stream is subject to additional processes to further lower the reactivity of the tar before hydroprocessing under Intermediate Hydroprocessing Conditions. These additional processes are collectively called "pretreatment" and include pretreatment hydroprocessing in a guard reactor and then further additional hydroprocessing in an intermediate hydroprocessing reactor.

D: Pretreatment in a Guard Reactor to Decrease Tar Reactivity and Decrease Fouling by any Particulates in Centrifuge Effluent to Lessen Pretreater Fouling.

Figure 8:
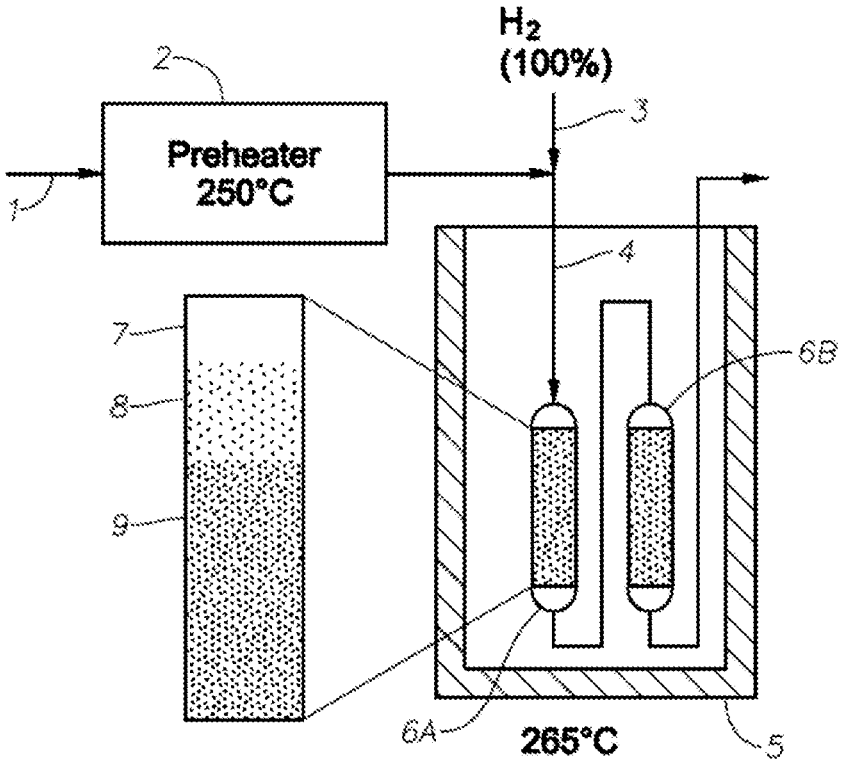
FIG. 8 shows a configuration of a guard reactor that can be used in the process.

A guard reactor (e.g. 704A, 704B in FIG. 2) is used to protect downstream reactors from fouling from reactive olefins and solids. In a preferred configuration (illustrated in FIGS. 1 and 2), two guard reactors are run in alternating mode—one on-line with the other off-line. When one of the guard reactors exhibits an undesirable increase in pressure drop, it is brought off-line so that it can be serviced and restored to condition for continued guard reactor operation. Restoration while off-line can be carried out, e.g., by replacing reactor packing and replacing or regenerating the reactor's internals, including catalyst. A plurality of (online) guard reactors can be used. Although the guard reactors can be arranged serially (e.g. as shown in FIG. 8), it is more typical for at least two guard reactors to be arranged in parallel, as in FIGS. 2 and 3. For example, two sets of the series guard reactors of FIG. 8 can be arranged in parallel.

Referring again to FIG. 2, a thermally treated tar composition having solids>25 μm substantially removed is conducted via line 66 for processing in at least one guard reactor. This composition is combined with recovered utility fluid supplied via line 310 to produce the tar-fluid mixture in line 320. Optionally, a supplemental utility fluid, may be added via conduit 330. A first pre-heater 70 preheats the tar-fluid mixture (which typically is primarily in liquid phase), and the pre-heated mixture is conducted to a supplemental pre-heating stage 90 via conduit 370. Supplemental pre-heater stage 90 can be, e.g., a fired heater. Recycled treat gas is obtained from conduit 265 and, if necessary, is mixed with fresh treat gas, supplied through conduit 131. The treat gas is conducted via conduit 20 through a second pre-heater 360, before being conducted to the supplemental pre-heat stage 90 via conduit 80. Fouling in the main hydroprocessing reactor 110 can be decreased by increasing feed preheater duty in pre-heaters 70 and 90.

Continuing with reference to FIG. 2, the pre-heated tar-fluid mixture (from line 380) is combined with the pre-heated treat gas (from line 390) and then conducted via line 410 to guard reactor inlet manifold 700. Mixing means (not shown) can be utilized for combining the pre-heated tar-fluid mixture with the pre-heated treat gas in guard reactor inlet manifold 700. The guard reactor inlet manifold directs the combined tar-fluid mixture and treat gas to online guard reactors, e.g. 704A, via an appropriate configuration of guard reactor inlet valves 702A, shown open, and 702B shown closed. An offline guard reactor 704B is illustrated, which can be isolated from the pretreatment inlet manifold by the closed valve 702B and a second isolation valve (not shown) downstream of the outlet of reactor 704B. On-line reactor 704A can also be brought off-line, and isolated from the process, when reactor 704B is brought on-line. Reactors 704A and 704B are typically brought off-line in sequence (one after the other) so that one 704A or 704B is on-line while the other is off-line, e.g., for regeneration. Effluent from the online guard reactor(s) is conducted to further downstream processes via a guard reactor outlet manifold 706 and line 708.

Figure 6:
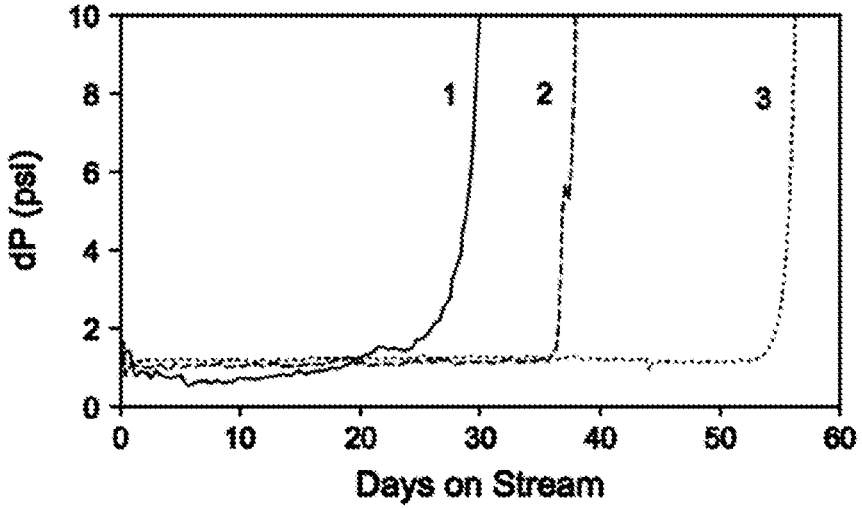
FIG. 6 shows the pressure drop across a reactor which utilizes as a feed a tar that has not been heat soaked. Lines 1, 2 and 3 are data from three representative runs.
Figure 7:
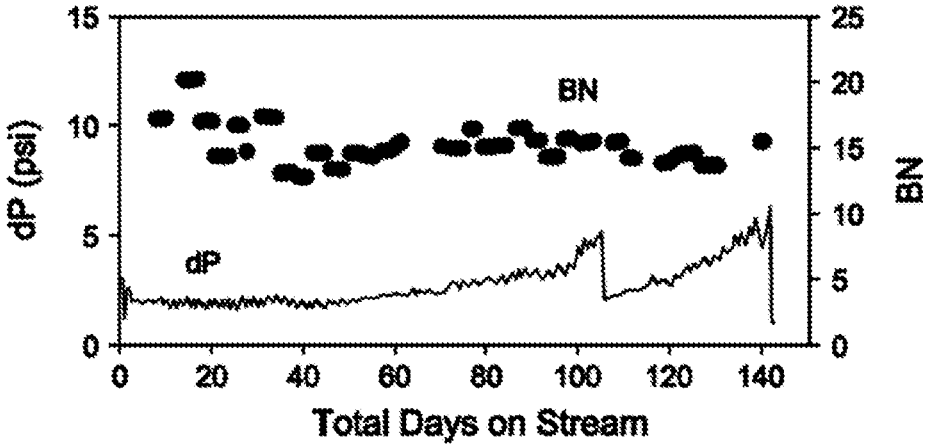
FIG. 7 shows the pressure drop (dP) across a reactor over a period of 140 days. The reactor's feed comprises 60 wt. % of heat soaked tar and 40 wt. % of mid-cut fraction. The figure also shows the variation in BN of the guard reactor's feed during this time period.

The guard reactor is best run with operating parameters that minimize fouling so that run-length targets can be met for the guard reactor, typically 1.5 to 6 months. The following exemplary results show that adequate run-length can be achieved by mitigating reactive fouling and solids fouling. FIGS. 6 and 7 compare pressure drop (dip) vs. time-on-stream (TOS) in a test reactor operating under guard reactor conditions with and without heat soaking the tar stream, respectively. Without heat soaking (FIG. 6) the test reactor, which is configured to simulate guard reactor/pretreater run conditions, developed excessive dP in a few weeks to less than 2 months. Tar BN was not measured in these tests, but is estimated to be in the range of from 30 BN to 40 BN on a tar basis or 19 BN and 25 BN on a feed basis, respectively, since the BN of a typical utility fluid, e.g., the BN of the mid-cut stream, is typically around 3 BN. Examination of plugged reactors from these test runs suggests that the plugging is at the catalyst bed entrance, ca. 2 to 3 inches (approx. 50 mm to 75 mm) of the top catalyst bed. The feed in these test runs has very low solids content (<50 ppm). Accordingly, the fouling is seemingly due to the formation of foulant from reactive olefins. With heat soaking (FIG. 7), the pilot unit run-length is much improved, to ~3 months or so. Feed reactivity (in BN units) is shown in the top curve, and is mostly below 18 BN on a feed basis or 28 BN on a tar basis. The two examples unequivocally demonstrate that reactive fouling can be mitigated via heat soaking. Equally important, fouling due to reactive olefins usually occurs in a relatively shallow layer at the top of the unit.

A configuration of a guard reactor used in another test of guard reactor performance is shown in FIG. 8. In FIG. 8, a tar feed 1 is preheated in a heater to the operating temperature, shown here for example as 250° C. The preheated tar feed is combined with a treat gas feed, illustrated here as molecular hydrogen, and the combined feed 4 is sent to the guard reactors 6A and 6B, shown in this example as arranged in series. Temperature control means 5 (e.g., a first sandbath) maintains the guard reactors at the operating temperature. The packing in the guard reactor is enlarged. 7 is a layer of a relatively low-reactivity hydroprocessing catalyst, 8 is a layer of hydrodemetallization catalyst. 9 is a layer of a relatively high-activity Ni/Co aluminate catalyst.

The configuration illustrated in FIG. 8 tests the solids (e.g., coke and polymeric) balance at the entrance and exit of the guard reactor. The sandbath simulates temperature regulation of a commercial guard bed, and temperature is maintained at 265° C. The amount of solids content is increased from <50 ppm to ca. 150 ppm to simulate the solids concentration of the centrifuge effluent. Also, the particle size of the input tar stream is controlled so that most particles are <25 μm. The feed for this guard reactor test is prepared by filtration. 80 to 100 ppm solids exited the reactor. Roughly 30% of solids are lost, for reasons that are not completely understood. Without being bound by any theory or model, there appears to be two mechanisms for the observed solids loss.

The first mechanism results from trapping solids in the dead volumes of the reactor. Even when care is taken to maximize circulation within the reactor and minimize dead volume in the reactor design, it is inevitable to have regions where solids deposit. In certain commercial aspect, solids deposition is anticipated to be much less or not a concern since mass flux is much higher and surface to volume ratio much lower in commercial units vs. the pilot scale unit used in the above-described example.

The second mechanism results from dissolution or decomposition of polymer solids in the reactor. There is substantial evidence to suggest that >50% solids in the feed are polymer in nature. Also, there seems to be evidence that the polymers are soluble in a good solvent such as the specified mid-cut utility-fluid stream and tar at elevated temperatures such as 250° C. or higher. Surprisingly, the solids exiting the guard reactor have almost identical particle size distribution (PSD) as the feed. Regardless of the loss mechanism, a substantial amount of the feed solids remain in the guard reactor's effluent. It is also observed that up to 32 days time-on-stream (TOS) is achieved during this example with substantially no increase in dP. As the guard reactor is operated in the presence of both reactive olefins and solids, the lack of any significant increase in dP indicates that there is no synergistic acceleration of fouling from solids interacting with reactive olefins.

Figure 9:
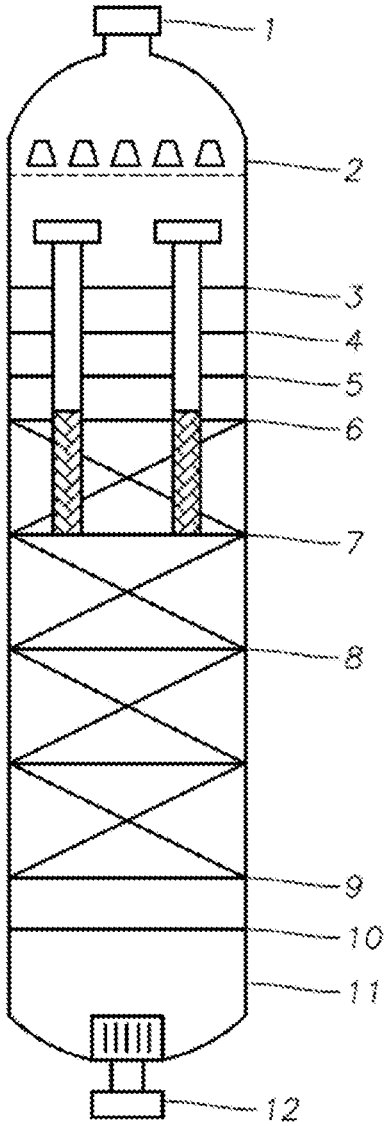
FIG. 9 shows another configuration of a guard reactor that can be used in the process.

Based on the above findings, one example guard reactor design is shown in FIG. 9. The guard reactor can be used, e.g., to protect the pretreatment hydroprocessing reactor and other downstream apparatus from reactive and solids fouling. The reactor also typically exhibits a run length that is of sufficient duration to allow for efficient switching in sequence of the guard reactor and a parallel second guard reactor from regeneration mode to hydroprocessing mode without an appreciable disruption of tar processing at locations downstream of the guard reactors. If needed, guard reactor run length can be increased, e.g., by incorporating a scale basket for diverting treat gas flow to a lower section of the reactor by bypassing reactor zones that have developed an undesirable dP increase.

In certain aspects, the guard reactor is configured with size grading to allow the single bed reactor to retain particles in the feed at a reactor depth which depends on size of the retained particulate. In certain aspects larger particles, e.g., having a size≥100 μm are retained in the upper part of the reactor, and smaller particles, e.g., having a size in the range of from 40 μm to 60 μm, are retained in a lower section of the reactor bed where smaller extrudates are packed. Alternatively or in addition, activity grading, e.g., by locating a less-active catalyst at the entrance of the guard reactor, can be used to moderate the reactor's exotherm. Without such moderation, thermal effects may accelerate reactive fouling and increase hydrogen consumption.

In the representative guard reactor of FIG. 9, 1 is an inlet configured to receive a tar-treat gas mixture. 2 is a "hat" providing clearance and flow distribution. 3 is a layer of a relatively high void-space ceramic topping material to provide relief of pressure drop caused by fouling. 4 and 5 are each layers of filter material that selectively traps particulates. 6, 7, 8, 9, 10, and 11 are each layers containing a catalytically effective amount of one or more materials having activity for catalytic hydroprocessing. The size and composition of each of these catalytic layers is independently selected, and each may be the same or different from any of the others. 12 is an outlet collector and outlet.

Figure 10:
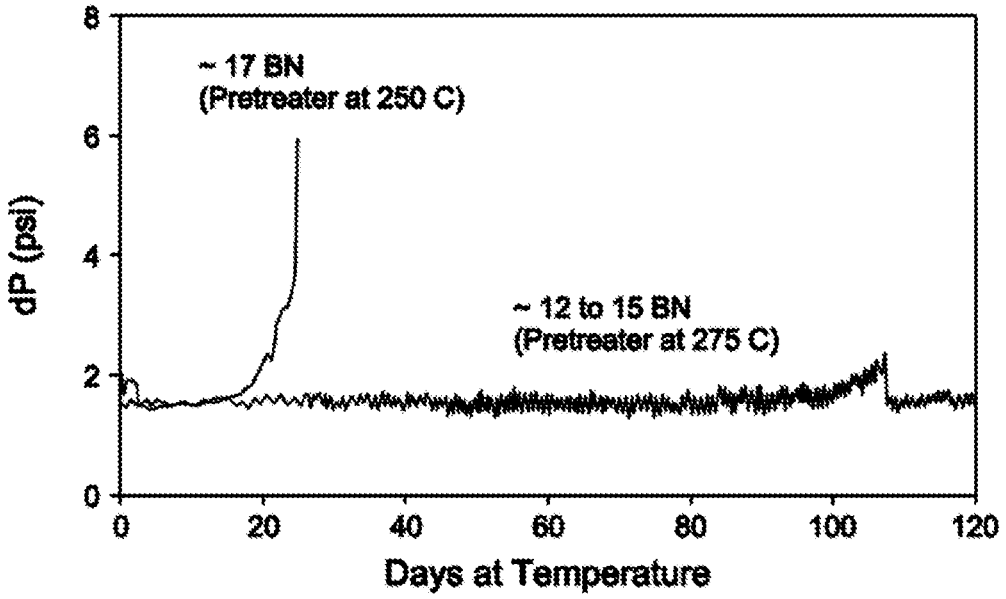
FIG. 10 shows the impact of pretreater effectiveness on pressure drop (dP) of a 1$^{st}$ stage reactor.

The guard reactor is operated under guard reactor hydroprocessing conditions. Typically, these conditions include a temperature in the range of from 200° C. to 300° C., more typically 200° C. to 280° C., or 250° C. to 280° C., or 250° C. to 270° C., or 260° C. to 300° C.; a total pressure in the range of from 1000 psia-1600 psia; typically 1300 psia to 1500 psia, a space velocity ("WHSV") in the range of from 5 $hr^{-1}$ to 7 $hr^{-1}$. The guard reactor contains a catalytically-effective amount of at least one hydroprocessing catalyst. Typically, upstream beds of the reactor include at least one catalyst having de-metallization activity, e.g., relatively large-pore catalysts to capture metals in the feed. Beds located further downstream in the reactor typically contain at least one catalyst having activity for olefin saturation, e.g., catalyst containing Ni and/or Mo. The guard reactor typically receives as feed a tar-fluid mixture having a reactivity $R_M$<18 BN on a feed basis, where the tar component of the tar-fluid mixture has an $R_T$ and/or $R_C$<30 BN, and preferably <28 BN, on a tar basis. Guard reactor run length is typically in the range of from 1.5 months to 6 months F: Additional Pretreatment Hydroprocessing in a Pretreatment Hydroprocessing Reactor A further pretreatment hydroprocessing is applied downstream from the guard reactor to lessen foulant accumulation in the first stage main reactor. As shown in FIG. 10, when the pretreater effluent, e.g., the effluent of pretreater F in FIG. 1, has a reactivity of 17 BN, reactor G exhibits an appreciable dP in about 20 days. When the reactivity of reactor F's effluent is in the range of from 12 BN to 15 BN, the run length of reactor G increased from 20 days to more than 3 months.

Certain forms of the pretreatment hydroprocessing reactor will now be described with continued reference to FIG. 2. In these aspects, the tar-fluid mixture is hydroprocessed under the specified Pretreatment Hydroprocessing Conditions described below to produce a pretreatment hydroprocessor (pretreater) effluent. The invention is not limited to these aspects, and this description is not meant to foreclose other aspects within the broader scope of the invention.

Pretreatment Hydroprocessing Conditions

The SCT composition is combined with utility fluid to produce a tar-fluid mixture that is hydroprocessed in the presence of molecular hydrogen under Pretreatment Hydroprocessing Conditions to produce a pretreatment hydroprocessing reactor effluent. The pretreatment hydroprocessing is typically carried out in at least one hydroprocessing zone located in at least one pretreatment hydroprocessing reactor. The pretreatment hydroprocessing reactor can be in the form of a conventional hydroprocessing reactor, but the invention is not limited thereto.

The pretreatment hydroprocessing is carried out under Pretreatment Hydroprocessing Conditions, to further lower the reactivity of the tar stream (tar-utility fluid stream) after the thermal treatment (e.g. by heat soaking) step and an initial stage of pretreatment in the guard reactor. Pretreatment Hydroprocessing Conditions include temperature $T_{PT}$, total pressure $P_{PT}$, and space velocity $WHSV_{PT}$. One or more of these parameters are typically different from those of the intermediate hydroprocessing ($T_1$, $P_1$, and $WHSV_1$). Pretreatment Hydroprocessing Conditions typically include one or more of $T_{PT}$≥150° C., e.g., ≥200° C. but less than $T_1$ (e.g., $T_{PT}$≤$T_1$−10° C., such as $T_{PT}$≤$T_1$−25° C., such as $T_{PT}$≤$T_1$−50° C.), a total pressure $P_{PT}$ that is ≥8 MPa but less than $P_1$, $WHSV_{PT}$≥0.3 $hr^{-1}$ and greater than $WHSV_I$ (e.g., $WHSV_{PT}$≥$WHSV_I$+0.01 $hr^{-1}$, such as ≥$WHSV_I$+0.05 $hr^{-1}$, or ≥$WHSV_I$+0.1 $hr^{-1}$, or ≥$WHSV_I$+0.5 $hr^{-1}$, or ≥$WHSV_I$+1 $hr^{-1}$, or ≥$WHSV_I$+10 $hr^{-1}$, or more), and a molecular hydrogen consumption rate that in the range of from 150 standard cubic meters of molecular hydrogen per cubic meter of the pyrolysis tar (S $m^3/m^3$) to about 400 S $m^3/m^3$ (845 SCF/B to 2250 SCF/B) but less than that of intermediate hydroprocessing. The Pretreatment Hydroprocessing Conditions typically include $T_{PT}$ in the range of from 260° C. to 300° C.; $WHSV_{PT}$ in the range of from 1.5 $hr^{-1}$ to 3.5 $hr^{-1}$, e.g., 2 $hr^{-1}$ to 3 $hr^{-1}$; a $P_{PT}$ in the range of from 6 MPa to 13.1 MPa; a molecular hydrogen supply rate in a range of about 600 standard cubic feet per barrel of tar-fluid mixture (SCF/B) (107 S $m^3/m^3$) to 1000 SCF/B (178 S $m^3/m^3$), and a molecular hydrogen consumption rate in the range of from 300 standard cubic feet per barrel of the pyrolysis tar composition in the tar-fluid mixture (SCF/B) (53 S $m^3/m^3$) to 400 SCF/B (71 S $m^3/m^3$). Using the specified Pretreatment Hydroprocessing Conditions results in an appreciably longer hydroprocessing duration without significant reactor fouling (e.g., as evidenced by no significant increase in hydroprocessing reactor pressure drop) than is the case when hydroprocessing a substantially similar tar-fluid mixture under more severe conditions, e.g., under Intermediate Hydroprocessing Conditions (described further below). The duration of pretreatment hydroprocessing without significantly fouling is typically at least 10 times longer than would be the case if more severe hydroprocessing conditions were used, e.g., ≥100 times longer, such as ≥1000 times longer. Although the pretreatment hydroprocessing can be carried out within one pretreatment hydroprocessing reactor, it is within the scope of the invention to use two or more reactors. For example, first and second pretreatment reactors can be used, where the first pretreatment hydroprocessing reactor operates at a lower temperature and greater space velocity within the Pretreatment Hydroprocessing Conditions than the second pretreatment hydroprocessing reactor.

Pretreatment hydroprocessing is carried out in the presence of hydrogen, e.g., by (i) combining molecular hydrogen with the tar-fluid mixture upstream of the pretreatment hydroprocessing, and/or (ii) conducting molecular hydrogen to the pretreatment hydroprocessing reactor in one or more conduits or lines. Although relatively pure molecular hydrogen can be utilized for the hydroprocessing, it is generally desirable to use a "treat gas" which contains sufficient molecular hydrogen for the pretreatment hydroprocessing and optionally other species (e.g., nitrogen and light hydrocarbons such as methane) which generally do not adversely interfere with or affect either the reactions or the products. The treat gas optionally contains ≥about 50 vol. % of molecular hydrogen, e.g., ≥75 vol. %, such as ≥90 wt. %, based on the total volume of treat gas conducted to the pretreatment hydroprocessing stage.

Typically, the pretreatment hydroprocessing in at least one hydroprocessing zone of the pretreatment hydroprocessing reactor is carried out in the presence of a catalytically-effective amount of at least one catalyst having activity for hydrocarbon hydroprocessing. Conventional hydroprocessing catalysts can be utilized for pretreatment hydroprocessing, such as those specified for use in resid and/or heavy oil hydroprocessing, but the invention is not limited thereto. Suitable pretreatment hydroprocessing catalysts include bulk metallic catalysts and supported catalysts. The metals can be in elemental form or in the form of a compound. Typically, the catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof. Conventional catalysts, e.g., RT-621, can be used, but the invention is not limited thereto.

In certain aspects, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In particular aspects, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

Typically, the tar-fluid mixture is primarily in the liquid phase during the pretreatment hydroprocessing. For example, ≥75 wt. % of the tar-fluid mixture is in the liquid phase during the hydroprocessing, such ≥90 wt. %, or ≥99 wt. %. The pretreatment hydroprocessing produces a pretreater effluent which at the pretreatment reactor's outlet comprises (i) a primarily vapor-phase portion including unreacted treat gas, primarily vapor-phase products derived from the treat gas and the tar-fluid mixture, e.g., during the pretreatment hydroprocessing, and (ii) a primarily liquid-phase portion which includes pretreated tar-fluid mixture, unreacted utility fluid, and products, e.g., cracked products, of the pyrolysis tar and/or utility fluid as may be produced during the pretreatment hydroprocessing. The liquid-phase portion (namely the pretreated tar-fluid mixture which comprises the pretreated pyrolysis tar) typically further comprises insolubles and has a reactivity ($R_F$)≤12 BN, e.g., ≤11 BN, such as ≤10 BN.

Certain aspects of the pretreatment hydroprocessing will now be described in more detail with respect to FIG. 2. As shown in the figure, guard reactor effluent flows from the guard reactor via line 708 to the pretreatment reactor 400. The guard reactor effluent can be mixed with additional treat gas (not shown); the additional treat gas can also be preheated. Mixing means (not shown) can be utilized for combining the guard reactor effluent with the pre-heated treat gas in pretreatment reactor 400, e.g., one or more gas-liquid distributors of the type conventionally utilized in fixed bed reactors.

The pretreatment hydroprocessing is carried out in the presence of hydroprocessing catalyst(s) located in at least one catalyst bed 415. Additional catalyst beds, e.g., 416, 417, etc., may be connected in series with catalyst bed 415, optionally with intercooling using treat gas from conduit 20 being provided between beds (not shown). Pretreater effluent is conducted away from pretreatment reactor 400 via conduit 110.

In certain aspects, the following Pretreatment Hydroprocessing Conditions are used to achieve the target reactivity (in BN) in the pretreater effluent: $T_{PT}$ in the range of from 250° C. to 325° C., or 275° C. to 325° C., or 260° C. to 300° C.; or 280° C. to 300° C.; $WHSV_{PT}$ in the range of from 2 $hr^{-1}$ to 3 $hr^{-1}$, $P_{PT}$ in the range of from 1000 psia to 1600 psia, e.g., 1300 psia to 1500 psia; and total pressure; a treat gas rate in the range of from 600 SCF/B to 1000 SCF/B, or 800 SCF/B to 900 SCF/B (on a feed basis). Under these conditions, the pretreater effluent's reactivity is typically <12 BN.

G: Intermediate Hydroprocessing for Hydrogenating and Desulfurizing in a Main Hydroprocessing Reactor Referring again to FIG. 1, a main hydroprocessing reactor G is used for carrying out most of the desired tar-conversion reactions, including hydrogenating and first desulfurizing reactions. The main hydroprocessing reactor adds approximately 800 SCF/B to 2000 SCF/B, of molecular hydrogen to the feed, e.g., approximately 1000 SCF/B to 1500 SCF/B, most of which is added to tar rather than to the utility fluid. The key reactions occurring in the main hydroprocessing reactor are summarized in scheme 2.

Scheme 2. Simplified reaction schemes summarizing main reactions occuring in the main hydroprocessing reactor.

1)

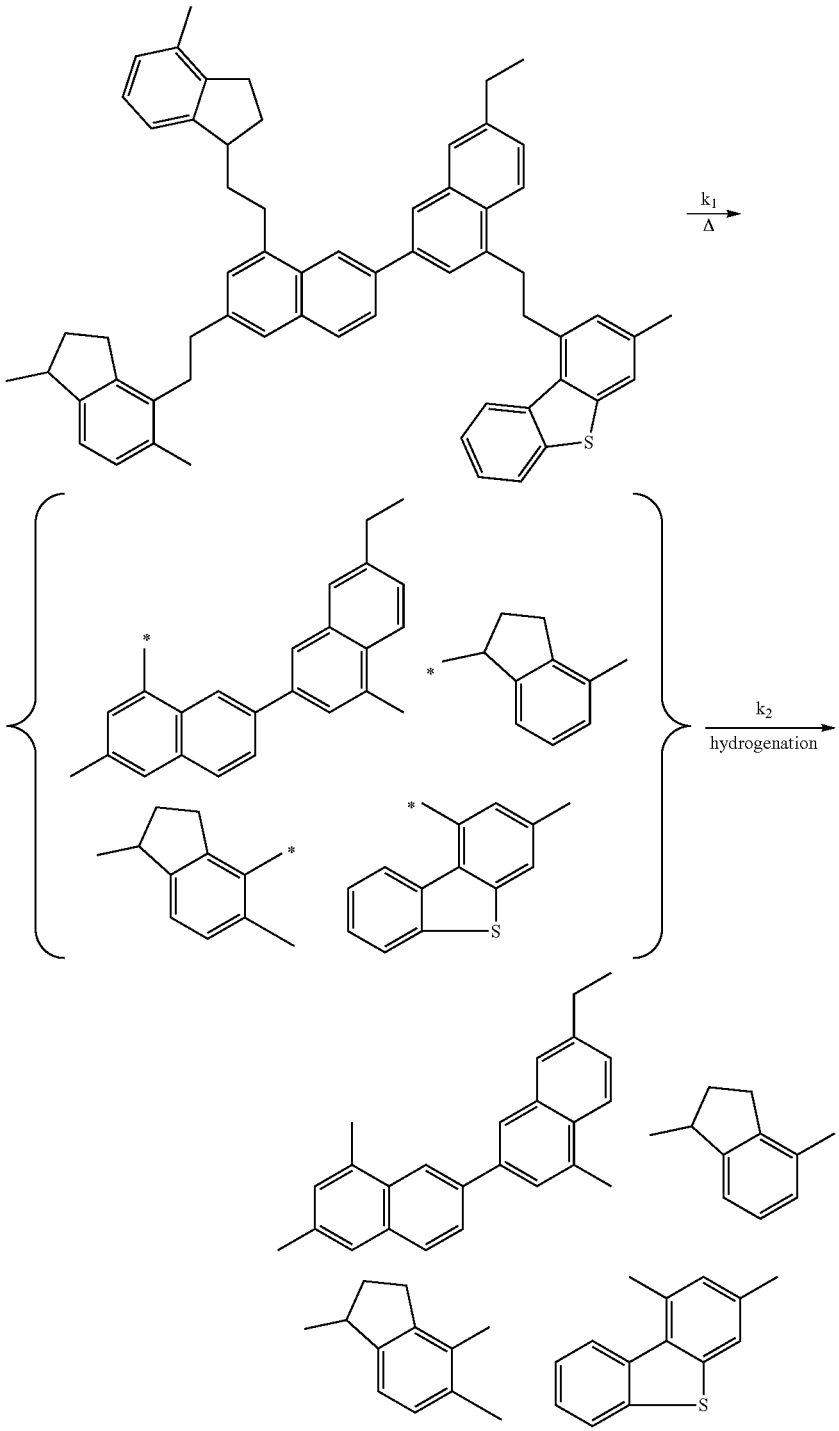

-continued

2)

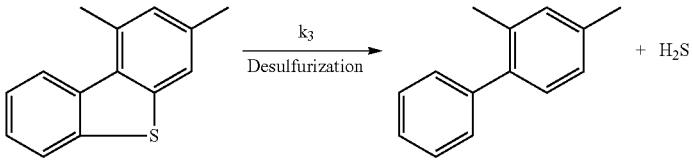

The first set of reactions (a first tar conversion) are the most important ones in reducing the size of tar molecules, particularly the size of TH. Doing so leads to a significant reduction in the tar's 1050 F+ fraction. The second set of reactions (hydrodesulfurization or HDS), desulfurizes the tar. For SCT, few alkyl chains survive the steam cracking—most molecules are dealkylated. As a result, the sulfur-containing molecules, e.g., benzothiophene or dibenzothiophenes, generally contain exposed sulfurs. These sulfur-containing molecules are readily removed using one or more conventional hydroprocessing catalysts, but the invention is not limited thereto. Suitable conventional catalysts include those comprising one or more of Ni, Co, and Mo on a support, such as aluminate ($Al_2O_3$).

A third set of reactions (a second tar conversion) can be used, and these typically include hydrogenation followed by ring opening to further reduce the size of tar molecules. A fourth set of reactions (aromatics saturation) can also be used. Adding hydrogen to the product of the first, second, or third reactions has been found to improve the quality of the hydroprocessed tar.

In certain aspects, intermediate hydroprocessing of at least a portion the pretreated tar-fluid mixture is carried out in reactor G under Intermediate Hydroprocessing Conditions, e.g., to effect at least hydrogenation and desulfurization. This intermediate hydroprocessing will now be described in more detail.

Intermediate Hydroprocessing of the Pretreated Tar-Fluid Mixture

In certain aspects not shown in FIG. 2, liquid and vapor portions are separated from the pretreater effluent. The vapor portion is upgraded to remove impurities such as sulfur compounds and light paraffinic hydrocarbon, and the upgraded vapor can be re-cycled as treat gas for use in one or more of hydroprocessing reactors 704, 400, 100 and 500. The separated liquid portion can be conducted to a hydroprocessing stage operating under Intermediate Hydroprocessing Conditions to produce a hydroprocessed tar. Additional processing of the liquid portion, e.g., solids removal, can be used upstream of the intermediate hydroprocessing.

In other aspects, as shown in FIG. 2, the entire effluent of the pretreater is conducted away from reactor 400 via line 110 for intermediate hydroprocessing of the entire pretreatment hydroprocessing effluent in a main hydroprocessing reactor 100 (Reactor G in FIG. 1). It will be appreciated by those skilled in the art, that for a wide range of conditions within the Pretreatment Hydroprocessing Conditions and for a wide range of tar-fluid mixtures, sufficient molecular hydrogen will remain in the pretreatment hydroprocessing effluent for the intermediate hydroprocessing of the pretreated tar-fluid mixture in main hydroprocessing reactor 100 without need for supplying additional treat gas, e.g., from the conduit 20.

Typically, the intermediate hydroprocessing in at least one hydroprocessing zone of the main hydroprocessing reactor is carried out in the presence of a catalytically-effective amount of at least one catalyst having activity for hydrocarbon hydroprocessing. The catalyst can be selected from among the same catalysts specified for use in the pretreatment hydroprocessing. For example, the intermediate hydroprocessing can be carried out in the presence of a catalytically effective amount hydroprocessing catalyst(s) located in at least one catalyst bed 115. Additional catalyst beds, e.g., 116, 117, etc., may be connected in series with catalyst bed 115, optionally with intercooling using treat gas from conduit 60 being provided between beds (not shown). The intermediate hydroprocessed effluent is conducted away from the main hydroprocessing reactor 100 via line 120.

The intermediate hydroprocessing is carried out in the presence of hydrogen, e.g., by one or more of (i) combining molecular hydrogen with the pretreatment effluent upstream of the intermediate hydroprocessing (not shown), (ii) conducting molecular hydrogen to the main hydroprocessing reactor in one or more conduits or lines (not shown), and (iii) utilizing molecular hydrogen (such as in the form of unreacted treat gas) in the pretreatment hydroprocessing effluent.

Typically, the Intermediate Hydroprocessing Conditions include $T_1$>400° C., e.g., in the range of from 300° C. to 500° C., such as 350° C. to 430° C., or 350° C. to 420° C., or 360° C. to 420° C., or 360° C. to 410° C.; and a $WHSV_I$ in the range of from 0.3 $hr^{-1}$ to 20 $hr^{-1}$ or 0.3 $hr^{-1}$ to 10 $hr^{-1}$, based on the weight of the pretreated tar-fluid mixture subjected to the intermediate hydroprocessing. It is also typical for the Intermediate Hydroprocessing Conditions to include a molecular hydrogen partial pressure during the hydroprocessing≥8 MPa, or ≥9 MPa, or ≥10 MPa, although in certain aspects it is ≤14 MPa, such as ≤13 MPa, or ≤12 MPa. For example, $P_1$ can be in the range of from 6 MPa to 13.1 MPa. Generally, $WHSV_I$ is ≥0.5 $hr^{-1}$, such as ≥1.0 $hr^{-1}$, or alternatively ≤5 $hr^{-1}$, e.g., ≤4 $hr^{-1}$, or ≤3 $hr^{-1}$. The amount of molecular hydrogen supplied to a hydroprocessing stage operating under Intermediate Hydroprocessing Conditions is typically in the range of from about 1000 SCF/B (standard cubic feet per barrel) (178 S $m^3/m^3$) to 10000 SCF/B (1780 S $m^3/m^3$), in which B refers to barrel of pretreated tar-fluid mixture that is conducted to the intermediate hydroprocessing. For example, the molecular hydrogen can be provided in a range of from 3000 SCF/B (534 S $m^3/m^3$) to 5000 SCF/B (890 S $m^3/m^3$). The amount of molecular hydrogen supplied to hydroprocess the pretreated pyrolysis tar component of the pretreated tar-fluid mixture is typically less than would be the case if the pyrolysis tar component was not pretreated and contained greater amounts of olefin, e.g., $C_{6+}$ olefin, such as vinyl aromatics. The molecular hydrogen consumption rate during Intermediate Hydroprocessing Conditions is typically in the range of 350 standard cubic feet per barrel (SCF/B, which is about 62 standard cubic meters/cubic meter (S $m^3/m^3$)) to about 1500 SCF/B (267 S $m^3/m^3$), where the denominator represents barrels of the pretreated pyrolysis tar, in the range of about 1000 SCF/B (178 S $m^3/m^3$) to 1500 SCF/B (267 S $m^3/m^3$), or about 2200 SCF/B (392 S $m^3/m^3$) to 3200 SCF/B (570 S $m^3/m^3$).

Within the parameter ranges (T, P, WHSV, etc.) specified for Intermediate Hydroprocessing Conditions, particular hydroprocessing conditions for a particular pyrolysis tar are typically selected to (i) achieve the desired 566° C.+ conversion, typically ≥20 wt. % substantially continuously for at least ten days, and (ii) produce a TLP and hydroprocessed pyrolysis tar having the desired properties, e.g., the desired density and viscosity. The term 566° C.+ conversion means the conversion during hydroprocessing of pyrolysis tar compounds having boiling a normal boiling point≥566° C. to compounds having boiling points<566° C. This 566° C.+ conversion includes a high rate of conversion of THs, resulting in a hydroprocessed pyrolysis tar having desirable properties.

The hydroprocessing can be carried out under Intermediate Hydroprocessing Conditions for a significantly longer duration without significant reactor fouling (e.g., as evidenced by no significant increase in reactor dP during the desired duration of hydroprocessing, such as a pressure drop of ≤140 kPa during a hydroprocessing duration of 10 days, typically ≤70 kPa, or ≤35 kPa) than is the case under substantially the same hydroprocessing conditions for a tar-fluid mixture that has not been pretreated. The duration of hydroprocessing without significantly fouling is typically least 10 times longer than would be the case for a tar-fluid mixture that has not been pretreated, e.g., ≥100 times longer, such as ≥1000 times longer.

In certain aspects, Intermediate Hydroprocessing Conditions include a $T_1$ in the range of from 320° C. to 450° C., or 340° C. to 425° C., or 360° C. to 410° C., or 375° C. to 410° C.; $P_1$ in the range of from 1000 psi to 1600 psi, typically 1300 psi to 1500 psi; $WHSV_I$ in the range of from 0.5 to 1.2 $hr^{-1}$, typically 0.7 $hr^{-1}$ to 1.0 $hr^{-1}$, or 0.6 $hr^{-1}$ to 0.8 $hr^{-1}$, or 0.7 $hr^{-1}$ to 0.8 $hr^{-1}$; and a treat gas rate in the range of from 2000 SCF/B to 6000 SCF/B, or 2500 SCF/B to 5500 SCF/B, or 3000 SCF/B to 5000 SCF/B (feed basis). Feed to the main reactor typically has a reactivity<12 BN. The weight ratio of tar:utility fluid in the feed to the main reactor is typically in the range of from 50 to 80:50 to 20, typically 60:40. Typically the intermediate hydroprocessing (hydrogenating and desulfurizing) adds from 1000 SCF/B to 2000 SCF/B of molecular hydrogen (feed basis) to the tar, and can reduce the sulfur content of the tar by ≥80 wt. %, e.g., ≥95 wt. %, or in the range of from 80 wt. % to 90 wt. %.

H: Recovering the Intermediate Hydroprocessed Pyrolysis Tar

Referring again to FIG. 2, the hydroprocessor effluent is conducted away from the main hydroprocessing reactor 100 via line 120. When the second and third preheaters (360 and 70) are heat exchangers, the hot hydroprocessor effluent in conduit 120 can be used to preheat the tar/utility fluid and the treat gas respectively by indirect heat transfer. Following this optional heat exchange, the hydroprocessor effluent is conducted to separation stage 130 for separating total vapor product (e.g., heteroatom vapor, vapor-phase cracked products, unused treat gas, etc.) and TLP from the hydroprocessor effluent. The total vapor product is conducted via line 200 to upgrading stage 220, which typically comprises, e.g., one or more amine towers. Fresh amine is conducted to stage 220 via line 230, with rich amine conducted away via line 240. Regenerated treat gas is conducted away from stage 220 via line 250, compressed in compressor 260, and conducted via lines 265, 20, and 21 for re-cycle and re-use in the main hydroprocessing reactor 100 and optionally in the $2^{nd}$ hydroprocessing reactor 500.

The TLP from separation stage 130 typically comprises hydroprocessed pyrolysis tar, e.g., ≥10 wt. % of hydroprocessed pyrolysis tar, such as ≥50 wt. %, or ≥75 wt. %, or ≥90 wt. %. The TLP optionally contains non-tar components, e.g., hydrocarbon having a true boiling point range that is substantially the same as that of the utility fluid (e.g., unreacted utility fluid). The TLP is useful as a diluent (e.g., a flux) for heavy hydrocarbons, especially those of relatively high viscosity. Optionally, all or a portion of the TLP can substitute for more expensive, conventional diluents. Non-limiting examples of blendstocks suitable for blending with the TLP and/or hydroprocessed tar include one or more of bunker fuel; burner oil; heavy fuel oil, e.g., No. 5 and No. 6 fuel oil; high-sulfur fuel oil; low-sulfur fuel oil; regular-sulfur fuel oil (RSFO); gas oil as may be obtained from the distillation of crude oil, crude oil components, and hydrocarbon derived from crude oil (e.g., coker gas oil), and the like. For example, the TLP can be used as a blending component to produce a fuel oil composition comprising <0.5 wt. % sulfur. Although the TLP is an improved product over the pyrolysis tar feed, and is a useful blendstock "as-is", it is typically beneficial to carry out further processing.

In the aspects illustrated in FIG. 2, TLP from separation stage 130 is conducted via line 270 to a further separation stage 280, e.g., for separating from the TLP one or more of hydroprocessed pyrolysis tar, additional vapor, and at last one stream suitable for use as recycle as utility fluid or a utility fluid component. Separation stage 280 may be, for example, a distillation column with side-stream draw although other conventional separation methods may be utilized. An overhead stream, a side stream and a bottoms stream, listed in order of increasing boiling point, are separated from the TLP in stage 280. The overhead stream (e.g., vapor) is conducted away from separation stage 280 via line 290. Typically, the bottoms stream conducted away via line 134 comprises >50 wt. % of hydroprocessed pyrolysis tar, e.g., ≥75 wt. %, such as ≥90 wt. %, or ≥99 wt. %; and typically accounts for approximately 40 wt. % of the main rector's (reactor 100) TLP, and typically about 67 wt. % of tar feed.

At least a portion of the overhead and bottoms streams may be conducted away, e.g., for storage and/or for further processing. The bottoms stream of line 134 can be desirably used as a diluent (e.g., a flux) for heavy hydrocarbon, e.g., heavy fuel oil. When desired, at least a portion of the overhead stream 290 is combined with at least a portion of the bottoms stream 134 for a further improvement in properties.

Optionally, separation stage 280 is adjusted to shift the boiling point distribution of side stream 340 so that side stream 340 has properties desired for the utility fluid, e.g., (i) a true boiling point distribution having an initial boiling point≥177° C. (350° F.) and a final boiling point≤566° C. (1050° F.) and/or (ii) an $S_{BN}$≥100, e.g., ≥120, such as ≥125, or ≥130. Optionally, trim molecules may be separated, for example, in a fractionator (not shown), from separation stage 280 bottoms or overhead or both and added to the side stream 340 as desired. The side stream (a mid-cut) is conducted away from separation stage 280 via conduit 340. At least a portion of the side stream 340 can be utilized as utility fluid and conducted via pump 300 and conduit 310. Typically, the side stream composition of line 310 (the mid-cut stream) is at least 10 wt. % of the utility fluid, e.g., ≥25 wt. %, such as ≥50 wt. %.

The hydroprocessed pyrolysis tar product from the intermediate hydroprocessing has desirable properties, e.g., a 15°

C. density measured that is typically at least 0.10 g/cm$^3$ less than the density of the thermally-treated pyrolysis tar. For example, the hydroprocessed tar can have a density that is at least 0.12, or at least 0.14, or at least 0.15, or at least 0.17 g/cm$^3$ less than the density of the pyrolysis tar composition. The hydroprocessed tar's 50° C. kinematic viscosity is typically ≤1000 cSt. For example, the viscosity can be ≤500 cSt, e.g., ≤150 cSt, such as ≤100 cSt, or ≤75 cSt, or ≤50 cSt, or ≤40 cSt, or ≤30 cSt. Generally, the intermediate hydroprocessing results in a significant viscosity improvement over the pyrolysis tar conducted to the thermal treatment, the pyrolysis tar composition, and the pretreated pyrolysis tar. For example, when the 50° C. kinematic viscosity of the pyrolysis tar (e.g., obtained as feed from a tar knock-out drum) is ≥1.0×10$^4$ cSt, e.g., ≥1.0×10$^5$ cSt, ≥1.0×10$^6$ cSt, or ≥1.0×10$^7$ cSt, the 50° C. kinematic viscosity of the hydroprocessed tar is typically <200 cSt, e.g., <150 cSt, preferably, <100 cSt, <75 cSt, <50 cSt, <40 cSt, or <30 cSt. Particularly when the pyrolysis tar feed to the specified thermal treatment has a sulfur content≥1 wt. %, the hydroprocessed tar typically has a sulfur content≥0.5 wt. %, e.g., in a range of about 0.5 wt. % to about 0.8 wt. %.

Figure 11:
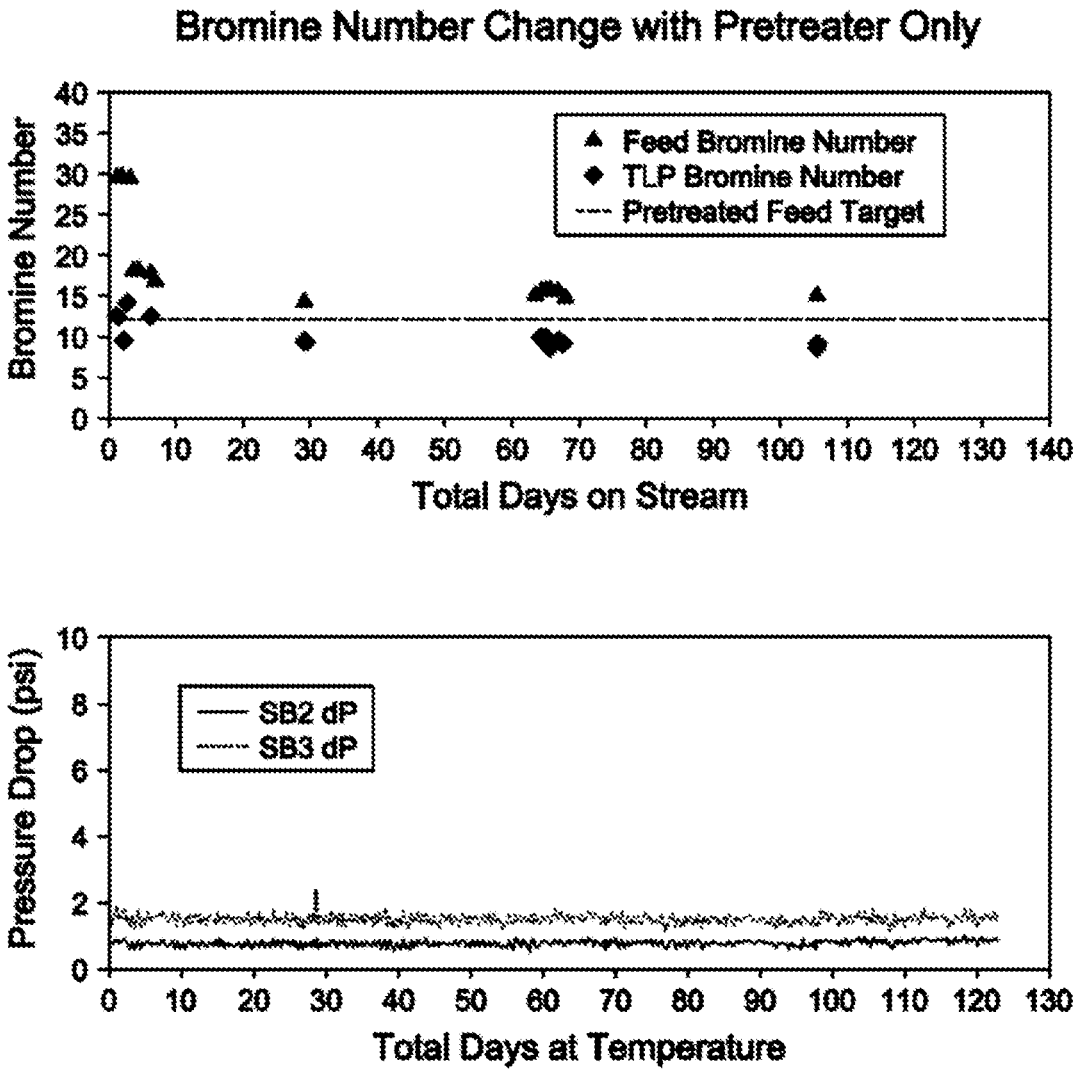
FIG. 11 (upper graph) shows a variation in tar-fluid mixture reactivity (closed triangles) and a variation TLP reactivity (closed diamonds) of a 1$^{st}$ stage of hydroprocessing that is located downstream of the pretreater. The lower graph shows the sensitivity of pressure drop across first and second catalyst beds of the reactor to TLP reactivity, the first bed being located in sandbed SB2 and the second being located in sandbed SB3.

FIG. 11 shows that an appreciable run length for the main hydroprocessing reactor can be achieved even when the tar-fluid mixture's reactivity is ≥15 BN. As shown, the TLP's reactivity does not exceed 12 BN. No appreciable dP increase is observed over 120 days on stream ("DOS") in the first and second stages of the main reactor, as shown in the lower dP curve (first stage, stabilized by a second sandbath [SB2]) and upper dP curve (second stage, stabilized by a third sandbath [SB3]).

J: Utility Fluid Recovery.

An advantage of the instant process is that at least part of the utility fluid can be obtained from a recycle stream. Typically 70 wt. % to 85 wt. % of the mid-cut stream from fractionator 280 is recycled as at least a portion of the utility fluid.

The amount of recycled utility fluid in the tar-fluid mixture is typically 40 wt. %, based on the weight of the tar-fluid mixture, but can range from 20 wt. % to 50 wt. %, or from 30 wt. % to 45 wt. %.

Figure 12:
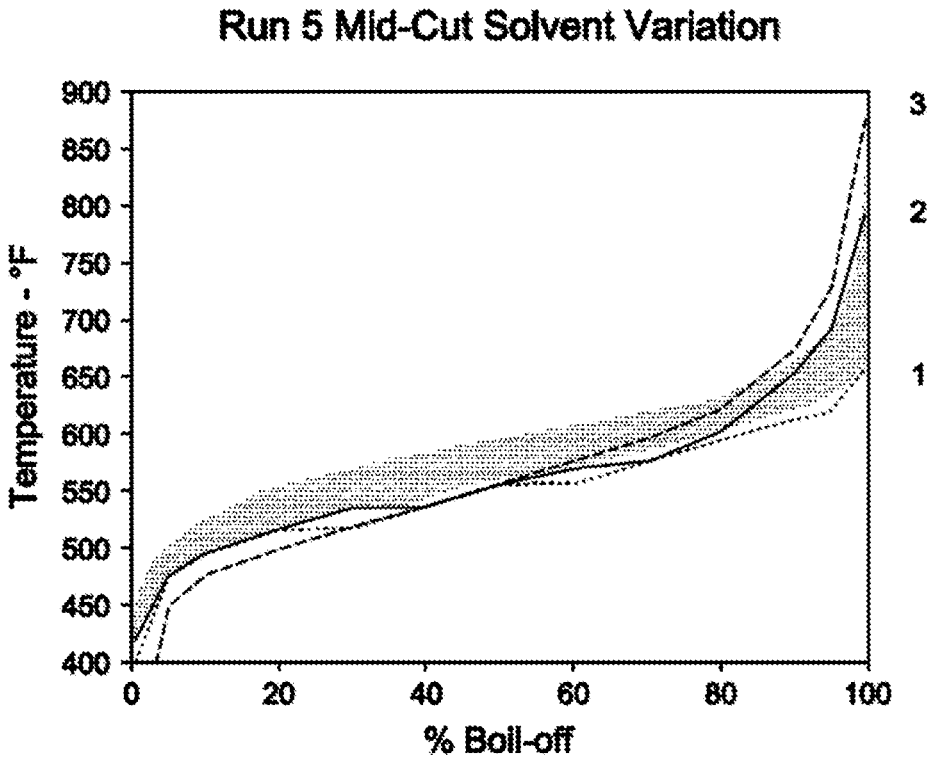
FIG. 12 compares distillation curves of mid-cut fractions resulting from three representative separations: 1—vacuum distillation, 2—commercial fractionation, 3—equilibrium flash separators.

Simulations indicate that a distillation column may be needed to recover a utility fluid having the specified $S_{BN}$. Fractionation gives a mid-cut composition that very closely resembles the desired utility fluid composition modeled by such simulations. True boiling distributions for three representative utility fluids are shown in FIG. 12.

An additional 20 wt. % or so of utility fluid (based on the total weight of utility fluid employed) is generated in each cycle, mostly as a result of conversion during hydroprocessing of the tar's fraction having a normal boiling point≥1050° F. (566° C.). The additional utility fluid produced by the process is used to replenish any overly-hydrogenated utility fluid, which can be purged from the process together with a light stream in a distillation fractionator located downstream of the first stage main reactor. The recovered light stream comprises a major amount of 1-ring and 2-ring aromatics. In general, molecules boiling at <400° F., with the majority of the composition boiling at 350° F. About 2 kilobarrels per day (kbd) of mid-cut can drawn from the fractionators(s). Recovered utility fluid that is not recycled to the tar upgrading process can be stored for other uses, e.g. blending into a refinery diesel stream. The light stream can also be recovered and stored or transported for other uses.

L: Retreatment Reactor to Further Reduce Sulfur.

When it is desired to further improve properties of the hydroprocessed tar, e.g., by removing at least a portion of any sulfur remaining in hydroprocessed tar, an upgraded tar can be produced by optional retreatment hydroprocessing. Certain forms of the retreatment hydroprocessing will now be described in more detail with respect to FIG. 2. The retreatment hydroprocessing is not limited to these forms, and this description is not meant to foreclose other forms of retreatment hydroprocessing within the broader scope of the invention.

Referring again to FIG. 2, hydroprocessed tar (line 134) and treat gas (line 21) are conducted to retreatment reactor 500 via line 510. Retreatment reactor 500 is typically smaller than main reactor 100. Typically, the retreatment hydroprocessing in at least one hydroprocessing zone of the intermediate reactor is carried out in the presence of a catalytically-effective amount of at least one catalyst having activity for hydrocarbon hydroprocessing. For example, the retreatment hydroprocessing can be carried out in the presence hydroprocessing catalyst(s) located in at least one catalyst bed 515. Additional catalyst beds, e.g., 516, 517, etc., may be connected in series with catalyst bed 515, optionally with intercooling, e.g., using treat gas from conduit 20, being provided between beds (not shown). The catalyst can be selected from among the same catalysts specified for use in the pretreatment hydroprocessing. A retreater effluent comprising upgraded tar is conducted away from reactor 500 via line 135.

Although the retreatment hydroprocessing can be carried out in the presence of the utility fluid, it is typical that it be carried out with little or no utility fluid to avoid undesirable utility fluid hydrogenation and cracking under Retreatment Hydroprocessing Conditions, which are typically more severe than the Intermediate Hydroprocessing Conditions. For example, (i)≥50 wt. % of liquid-phase hydrocarbon present during the retreatment hydroprocessing is hydroprocessed tar obtained from line 134, such as ≥75 wt. %, or ≥90 wt. %, or ≥99 wt. %, and (ii) utility fluid comprises ≤50 wt. % of the balance of the of liquid-phase hydrocarbon, e.g., ≤25 wt. %, such as ≤10 wt. %, or ≤1 wt. %. In certain aspects, the liquid phase hydrocarbon present in the retreatment reactor is a hydroprocessed tar that is substantially-free of utility fluid. Sulfur content of the feed to the (optional) retreatment reactor is typically 0.5 wt. % to 0.8 wt. %, or perhaps from 0.3 to 0.8 wt. %. Since this amount is well above ECA spec (0.1 wt. %), a retreatment reactor is beneficial in reducing sulfur to the ECA-specified value or less. Another advantageous feature resides in improving tar compatibility, so that the final upgraded tar product can be blended with low density, high cetane number refinery streams without precipitating solids.

The Retreatment Hydroprocessing Conditions (retreatment temperature $T_R$, total pressure $P_R$, and space velocity $WHSV_R$) typically include $T_R$≥370° C.; e.g., in the range of from 350° C. to 450° C., or 370° C. to 415° C., or 375° C. to 425° C.; $WHSV_R$≤0.5 hr$^{-1}$, e.g., in the range of from 0.2 hr$^{-1}$ to 0.5 hr$^{-1}$, or from 0.4 hr$^{-1}$ to 0.7 hr$^{-1}$; a molecular hydrogen supply rate≥3000 SCF/B, e.g., in the range of from 3000 SCF/B (534 S m$^3$/m$^3$) to 6000 SCF/B (1068 S m$^3$/m$^3$); and $P_R$≥6 MPa, e.g., in the range of from 6 MPa to 13.1 MPa. Optionally, $T_R$>$T_1$ and/or $WHSV_R$<$WHSV_I$. Little or no fouling is typically observed in the retreatment reactor, mainly, it is believed, because the retreatment reactor's feed has been subjected to hydroprocessing in reactor 100. However, since most of the easy-to-remove sulfur is removed in the reactor 100, more severe run conditions are needed in the retreatment reactor 500 in order to meet a product sulfur spec of 0.1 wt. %. When the hydroprocessed tar has a sulfur content≥0.3 wt. %, e.g., in the range of from 0.3 wt. % to 0.8 wt. %, or about 0.5 wt. %, these more severe conditions can include $T_R$ in the range of from 360° C. to 425° C., typically from 370° C. to 415° C.; PR in the range of from 1200 psi to 1600 psi, e.g., 1300 psi to 1500 psi; a treat gas rate in the range of from 3000 SCF/B to 5000 SCF/B (feed basis); $WHSV_R$ in the range of from 0.2 $hr^{-1}$ to 0.5 $hr^{-1}$. Conventional catalysts can be used, but the invention is not limited thereto, e.g., catalysts comprising one or more of Co, MO, and Ni on a refractory support, e.g., alumina and/or silica.

The upgraded tar typically has a sulfur content<0.3 wt. %, e.g., ≤0.2 wt. %. Other properties of the upgraded tar include a hydrogen:carbon molar ratio≥1.0, e.g., ≥1.05, such as ≥1.10, or ≥1.055; an $S_{BN}$≥185, such as ≥190, or ≥195; an $I_N$≤105, e.g., ≤100, such as ≤95; a 50° C. kinematic viscosity is typically ≤1000 cSt, e.g., ≤900 cSt, such as ≤800 cSt; a 15° C. density≤1.1 g/$cm^3$, e.g., ≤1.09 g/$cm^3$, such as ≤1.08 g/$cm^3$, or ≤1.07 g/$cm^3$; a flash point≥, or ≤−35° C. Generally, the retreating results in a significant improvement in one or more of viscosity, $S_{BN}$, $I_N$, and density over that of the hydroprocessed tar fed to the retreater. Desirably, since the retreating can be carried out without utility fluid, these benefits can be obtained without utility fluid hydrogenation or cracking. The upgraded tar can be blended with one or more blendstocks, e.g., to produce a lubricant or fuel, e.g., a transportation fuel. Suitable blendstocks include those specified for blending with the TLP and/or hydroprocessed tar. Selected properties of upgraded tar produced from four representative SCT samples as feed are set out in Table 2.

TABLE 2

| | Feed #1 | Feed #2 | Feed #3 | Feed #4 |
|---|---|---|---|---|
| Density (90° C.) | 1.0473 | 1.0517 | 1.0550 | — |
| Sulfur, wt. % | 0.618 | 0.694 | 0.734 | 0.674 |
| Sulfur, wt. % | — | 0.07 | — | — |
| Basic Nitrogen, wppm | — | 0.032 | — | — |
| Hydrogen, wt. % | 7.97 | 7.83 | 7.8 | 7.43 |
| Conradson Carbon, wt. % | 11.1 | 11.9/13.6 | 11.5 | 11.8 |
| n-C7 insolubles, wt. % | 3.4 | 3.8 | 3.9 | 2.5 |
| Viscosity @60 C., $mm^2/s$ | 2723 | 4835 | 9738 | 6513 |
| DISTILATION | | | | |
| IBP, ° F. | 554.5 | 344.0 | 566.9 | 561.7 |
| 10% off | 653.1 | 659.0 | 668.2 | 665.6 |
| 20% off | 691.7 | 699.5 | 710.0 | 706.1 |
| 30% off | 733.4 | 742.5 | 754.5 | 747.7 |
| 40% off | 780.1 | 791.3 | 803.5 | 794.2 |
| 50% off | 834.6 | 846.7 | 859.1 | 846.7 |
| 60% off | 898.8 | 912.5 | 924.8 | 909.0 |
| 70% off | 975.9 | 990.2 | 1000.6 | 983.3 |
| 80% off | 1071.0 | 1086.4 | 1093.4 | 1074.7 |
| 90% off | 1194.2 | 1209.4 | 1210.7 | 1193.7 |
| 95% off | 1277.7 | 1291.4 | 1287.7 | 1274.9 |
| 99.5% off | 1367.1 | 1370.6 | 1366.1 | 1365.9 |

M: Blending.

Even after retreatment, certain properties of the upgraded tar may not be in conformity with specifications for ECA fuel or low-sulfur fuel oil (LSFO). In such cases, blending may be needed to meet those specifications. Table 3 compares expected specifications with selected properties of upgraded tar (second stage product) and, for comparison, an aromatic gas oil (THHAGO).

TABLE 3

ECA/LSFO specs, properties of a refinery stream suitable for blending and properties of retreater product.

| Property | Specification | THHAGO | $2^{nd}$ Stage Product |
|---|---|---|---|
| C (wt. %) | | 86.6 | 90.6 |
| H (wt. %) | | 12.8 | 8.66 |
| N (wt. %) | | <0.10 | <0.10 |
| H/C | | | 1.15 |
| S (wt. %) | <0.1 | 0.0349 | 0.122 |
| Sediment (wt. %) | <0.1 | — | <0.1 |
| KV50 (cSt) | | 9.146 | 709.8 |
| CCAI | <870 | | 917 |
| Conradson Carbon (wt. %) | | <0.001 | 8.08 |
| Flash Point (° C.) | >60 | 162 | 154 |
| Pour Point (° C.) | <30 | 12 | −36 |

As shown by the table, the expected specifications can be met or even exceeded by blending the upgraded tar with the heavy aromatic gas oil. (THHAGO), whose properties are also listed in table 3, as one such stream. This is a hydrotreated heavy AGO with lower value than ECA. By blending with the product of the tar upgrade process described herein, one can add value to other refinery streams such as THHAGO. Moreover, since crude-based streams such as THHAGO typically have high hydrogen content, additional hydrotreating leads to opportunity to increase density and cetane content of such a crude-based product in blending to make a LSFO/ECA fuel. The upgraded tar can be used for such a blend.

As an example, a blend is prepared comprising 45 wt. % THHAGO and 55 wt. % of the upgraded tar. Table 4 below lists the properties of this example blend as well as specs for ISO8217 RMG380 (ECA spec).

TABLE 4

Properties of a blend made of 55 wt. % $2^{nd}$ stage product and 45 wt. % THHAGO.

| Property | Example Blend | ISO8217 RMG380 Specification |
|---|---|---|
| KV50 ($mm^2/s$) | 42.40 | <380.0 |
| Density at 15° C. (kg/$m^3$) | 978.9 | <991.0 |
| CCAI | 867.8 | <870 |
| Sulfur (wt. %) | 0.0987 | <0.10 |
| Flash Point | >130.0 | >60 |
| H2S (mg/kg) | <0.40 | <2.00 |
| Acid Number (mg KOH/g) | 0.05 | <2.5 |
| Total Sediment Aged (wt. %) | 0.01 | <0.10 |
| MCR (wt. %) | 3.7 | <18.00 |
| Pour Point (° C.) | −12 | <30 |
| Water (vol. %) | 0.00 | <0.50 |
| Ash (wt. %) | 0.0230 | <0.100 |
| Vanadium (mg/kg) | <1 | <350 |
| Sodium (mg/kg) | 3 | <100 |
| Aluminum plus Silicon (mg/kg) | 5 | <60 |
| Calcium (mg/kg) | <1 | <30 |
| Zinc (mg/kg) | <1 | <15 |
| Phosphorus (mg/kg) | 1 | <15 |

The example blend is compatible given that the sediment content (0.01 wt. %) is well below ECA specification (0.1 wt. %). Both density and CCAI, as well as all other ECA specifications are met or exceeded.

The description in this application is intended to be illustrative and not limiting of the invention. One in the skill of the art will recognize that variation in materials and methods used in the invention and variation of embodiments of the invention described herein are possible without departing from the invention. It is to be understood that some embodiments of the invention might not exhibit all of the advantages of the invention or achieve every object of the invention. The scope of the invention is defined solely by the claims following.

The invention claimed is:

1. A process for preparing a low sulfur liquid hydrocarbon product comprising:

i) heat soaking a tar stream to obtain a first process stream comprising reduced reactivity tar;

ii) blending the first process stream with a utility fluid to reduce the viscosity of the first process stream and obtain a second process stream comprising reduced reactivity, lower viscosity tar;

iii) removing solids from the second process stream to provide a third process stream comprising a reduced reactivity, lower viscosity tar that is substantially free of solids of size larger than 25 μm;

iv) passing the third process stream through a guard reactor that further removes reactive olefins and residual solids to produce an upgraded third process stream, and then pretreating the upgraded third process stream to further lower the reactivity of the tar and obtain a fourth process stream having a Bromine Number (BN) lower than 12;

v) hydrogenating and desulfurizing the fourth process stream and recovering a total liquids product (TLP);

vi) distilling the TLP and recovering a mid-cut of the distillation products and a heavy bottoms fraction;

vii) desulfurizing the heavy bottoms fraction to obtain a low sulfur product having a sulfur content of about 0.3 wt. % or less.

2. The process of claim 1, further comprising recycling a portion of the mid-cut as at least a portion of the utility fluid used in step ii).

3. The process of claim 1, further comprising blending the low sulfur product with an aromatic gas oil.

4. The process of claim 1, further comprising producing an ECA stream that includes the low sulfur product.

5. The process of claim 1, wherein the reduced reactivity tar has a reactivity≤28 BN.

6. The process of claim 1, wherein the heat soaking step is performed at a temperature in the range of from 200° C. to 300° C., and for a time in the range of from 2 minutes to 30 minutes.

7. The process of claim 1, wherein the solids removal step ii) includes centrifugation.

8. The process of claim 1, wherein the hydrogenating and desulfurizing step v) adds from 1000 SCF/B to 2000 SCF/B of molecular hydrogen on a feed basis to the tar and reduces sulfur content of the tar by 80 wt. % to 95 wt. %.

9. The process of claim 1, wherein the heavy bottoms desulfurizing step vii) provides a product having a sulfur content of 0.1% or less.

10. The process of claim 1, that further comprises recycling a portion of the mid-cut as at least a portion of the utility fluid used in step ii), and wherein 70 wt. % to 85 wt. % of the recycled mid-cut is included in the utility fluid.

11. The process of claim 1, wherein the pretreatment step (iv) is performed at a temperature in the range of from 260° C. to 300° C. and a feed weight hourly space velocity (WHSV) in the range of from of 2 $hr^{-1}$ to 3 $hr^{-1}$.

12. The process of claim 1, wherein the hydrogenating and desulfurizing step v) is performed at a temperature in the range of from 375° C. to 410° C. and a space velocity (WHSV, feed basis) in the range of from 0.7 $hr^{-1}$ to 1.0 $hr^{-1}$.

13. The process of claim 1, wherein the desulfurizing step vii) is performed at a temperature in the range of from 375° C. to 425° C. and a space velocity (WHSV, feed basis) in the range of from 0.4 $hr^{-1}$ to 0.7 $hr^{-1}$.

14. The process of claim 7, wherein (A) the heat soaking step is performed at a temperature in the range of from 200° C. to 300° C. for a time in the range of from 2 minutes to 30 minutes, (B) the second process stream comprises 20 wt. % to 50 wt. % solids, and (C) the centrifugation is performed at a temperature in the range of from 80° C. to 100° C. and a force of 2000×g to 6000×g.

15. The process of claim 1, wherein the tar stream has a reactivity≥30 BN.

16. The process of claim 1, wherein the heat soaking achieves a reactivity in the reduced reactivity tar that is ≤28 BN, and the second process stream comprises the utility fluid in an amount <10 wt. % of the second process stream.

17. The process of claim 1, wherein the guard reactor is operated at a temperature in the range of from 260° C. to 300° C. and a space velocity (WHSV, feed basis) in the range of from 5 $hr^{-1}$ to 7 $hr^{-1}$.

18. The process of claim 12, wherein the hydrogenating and desulfurizing of step v) is performed in a reactor packed with a plurality of different catalysts arranged so that each catalyst forms a bed and the beds are arranged serially.

19. The process of claim 18, wherein at least one of the catalysts of step v) contains one or more of Co, Ni, or Mo.

20. The process of claim 1, in which the guard reactor is packed with a plurality of different catalysts arranged so that each catalyst forms a bed and the beds are arranged serially.

21. The process of claim 20, wherein at least one of the catalysts in the guard reactor contains one or more of Co, Ni, or Mo.

22. The process of claim 13, wherein the desulfurizing step vii) is performed in a reactor packed with a catalyst that contains one or more of Co, Ni, or Mo.

* * * * *